US008960868B1

(12) United States Patent
Turgeman

(10) Patent No.: US 8,960,868 B1
(45) Date of Patent: Feb. 24, 2015

(54) INK PREDISPENSE PROCESSING AND CARTRIDGE FILL METHOD AND APPARATUS

(71) Applicant: Shahar Turgeman, Boca Raton, FL (US)

(72) Inventor: Shahar Turgeman, Boca Raton, FL (US)

( * ) Notice: Subject to any disclaimer, the term of this patent is extended or adjusted under 35 U.S.C. 154(b) by 0 days.

(21) Appl. No.: 14/011,683

(22) Filed: Aug. 27, 2013

Related U.S. Application Data

(63) Continuation-in-part of application No. 13/851,067, filed on Mar. 26, 2013, now Pat. No. 8,567,929, which is a continuation of application No. 12/753,448, filed on Apr. 2, 2010, now Pat. No. 8,403,466, application No. 14/011,683, which is a continuation-in-part of application No. 13/352,290, filed on Jan. 17, 2012, now Pat. No. 8,517,524, which is a continuation-in-part of application No. 12/575,438, filed on Oct. 7, 2009, now Pat. No. 8,157,362, which is a continuation-in-part of application No. 12/363,572, filed on Jan. 30, 2009, now Pat. No. 8,096,630, and a continuation-in-part of application No. 11/342,442, filed on Jan. 30, 2006, now abandoned.

(51) Int. Cl.
*B41J 2/175* (2006.01)
*B41J 2/19* (2006.01)

(52) U.S. Cl.
CPC ..... *B41J 2/17506* (2013.01)
USPC ..... 347/85; 347/92; 347/93

(58) Field of Classification Search
USPC ..... 347/7, 84–87, 92, 93
See application file for complete search history.

(56) References Cited

U.S. PATENT DOCUMENTS

| | | | |
|---|---|---|---|
| 4,907,013 | A | 3/1990 | Hubbard et al. |
| 5,164,747 | A | 11/1992 | Osada et al. |
| 5,663,754 | A | 9/1997 | Lorenze, Jr. et al. |
| 5,835,108 | A | 11/1998 | Beauchamp et al. |
| 6,056,386 | A | 5/2000 | Nohata et al. |
| 6,058,984 | A | 5/2000 | Sato |
| 6,106,094 | A | 8/2000 | Otani et al. |
| 6,158,837 | A | 12/2000 | Hilton et al. |
| 6,199,977 | B1 | 3/2001 | Komplin et al. |
| 6,215,557 | B1 | 4/2001 | Owens |
| 6,261,353 | B1 | 7/2001 | Doi et al. |
| 6,273,151 | B1 | 8/2001 | Kong |
| 6,289,654 | B1 | 9/2001 | Yamaguchi et al. |
| 6,315,383 | B1 | 11/2001 | Sarmast et al. |
| 6,331,038 | B1 | 12/2001 | Boleda et al. |
| 6,332,481 | B1 | 12/2001 | Shinada et al. |
| 6,352,331 | B1 | 3/2002 | Armijo et al. |

(Continued)

*Primary Examiner* — Anh T Vo
(74) *Attorney, Agent, or Firm* — Allen D. Hertz, P.A.; Allen D. Hertz

(57) ABSTRACT

An automated system for filling printer ink cartridges comprising at least one of a particle filtration element and a degassing filter element for removal of suspended particles and gas from ink. The system transfers ink from a large ink reservoir to an ink dispending element which dispenses ink into reservoirs within printer ink cartridges. The system can include one or more of each of the particle filtration elements and the degassing filter elements. When a plurality of filtering elements are present, the filtering elements can be integrated into the system in a parallel arrangement, a serial arrangement or both. When both the particle filtration element(s) and the degassing filter element(s) are included, the particle filtration element(s) are located up-flow from the degassing filter element(s). The degassing filter element(s) are preferably located down-flow of an ink pump. The reduced particles and gasses improves the print quality and print head lifespan.

20 Claims, 28 Drawing Sheets

(56) References Cited

U.S. PATENT DOCUMENTS

| | | | |
|---|---|---|---|
| 6,361,138 | B1 | 3/2002 | Seino et al. |
| 6,539,985 | B2 | 4/2003 | Shinada et al. |
| 6,568,786 | B2 | 5/2003 | Sarmast et al. |
| 6,585,007 | B2 | 7/2003 | Kubokawa |
| 6,616,260 | B2 | 9/2003 | Skene et al. |
| 6,623,096 | B1 | 9/2003 | Castano et al. |
| 6,637,853 | B1 | 10/2003 | Ahne et al. |
| 6,644,772 | B2 | 11/2003 | Choi |
| 6,679,577 | B2 | 1/2004 | Du et al. |
| 6,705,694 | B1 | 3/2004 | Barbour et al. |
| 6,729,360 | B2 | 5/2004 | Sesek et al. |
| 6,764,155 | B2 | 7/2004 | D'Souza et al. |
| 6,799,842 | B2 | 10/2004 | Barinaga et al. |
| 6,973,943 | B2 | 12/2005 | Sesek et al. |
| 7,089,973 | B2 | 8/2006 | Nicodem et al. |
| 7,172,272 | B2 | 2/2007 | Tsuchiya et al. |
| 7,207,667 | B2 | 4/2007 | Ansier et al. |
| 7,344,215 | B2 | 3/2008 | Cutler et al. |
| 7,540,597 | B2 | 6/2009 | Guhse et al. |
| 7,780,276 | B2 | 8/2010 | Guhse et al. |
| 7,901,063 | B2 * | 3/2011 | Wouters et al. ..... 347/89 |
| 2001/0019343 | A1 | 9/2001 | Walker et al. |
| 2002/0149641 | A1 | 10/2002 | Du et al. |
| 2002/0175965 | A1 | 11/2002 | Skene et al. |
| 2003/0081062 | A1 | 5/2003 | Kim et al. |
| 2003/0146951 | A1 | 8/2003 | Skene et al. |
| 2004/0046811 | A1 | 3/2004 | D'Souza et al. |
| 2004/0263588 | A1 | 12/2004 | Ansier et al. |
| 2004/0263589 | A1 | 12/2004 | Ansier et al. |
| 2005/0018006 | A1 | 1/2005 | Im et al. |
| 2005/0034777 | A1 | 2/2005 | Nicodem et al. |
| 2005/0088495 | A1 | 4/2005 | Chan |
| 2005/0099447 | A1 | 5/2005 | Hsu et al. |
| 2006/0109320 | A1 | 5/2006 | Cutler et al. |
| 2007/0051421 | A1 | 3/2007 | Sarnoff et al. |
| 2007/0052740 | A1 | 3/2007 | Guhse et al. |
| 2007/0052748 | A1 | 3/2007 | Sarnoff et al. |
| 2007/0052770 | A1 | 3/2007 | Guhse et al. |
| 2007/0052776 | A1 | 3/2007 | Guhse et al. |
| 2007/0052777 | A1 | 3/2007 | Guhse et al. |

* cited by examiner

300

| 325 Printer Type | 330 Cartridge Model No. | 335 Required Ink Amount | 340 Run Time | 345 Pause Time |
|---|---|---|---|---|
| 1200 | 51640/C/M/Y | 42 | 1 | 1 |
| 5550 | C6657 | 17 | 1 | 2 |
| 2000C | C4841/C/M/Y | 28 | 2 | 3 |
| 1120 | C1823D | 30 | 1.5 | 1 |

305 310 315 320

*FIG. 3*

INK PREDISPENSE PROCESSING AND CARTRIDGE FILL METHOD AND APPARATUS

CROSS REFERENCE TO RELATED APPLICATIONS

This application is:

a Continuation-In-Part Patent Application of co-pending U.S. patent application Ser. No. 13/851,067 filed on Mar. 26, 2013 (scheduled to issue as U.S. Pat. No. 8,517,524 on Aug. 27, 2013), which is a Continuing Prosecution Patent Application claiming the benefit of U.S. Non-Provisional patent application Ser. No. 12/753,448, filed on Apr. 2, 2010 (Issued as U.S. Pat. No. 8,403,466 on Mar. 26, 2013), the contents of which are incorporated herein by reference into the present application, and a Continuation-In-Part Patent Application of co-pending U.S. patent application Ser. No. 13/352,290 filed on Jan. 17, 2012, which is a Continuation-In-Part Patent Application of co-pending U.S. patent application Ser. No. 12/575,438 filed on Oct. 7, 2009 (Issued as U.S. Pat. No. 8,157,362 on Apr. 17, 2012), which is a Continuation-In-Part Application claiming the benefit of co-pending U.S. patent application Ser. No. 12/363,572, filed Jan. 30, 2009 (issued as U.S. Pat. No. 8,096,630 on Jan. 17, 2012), which is a Continuation-In-Part Application claiming the benefit of co-pending U.S. patent application Ser. No. 11/342,442, filed Jan. 30, 2006 (now abandoned), the contents of which are incorporated herein by reference into the present application.

FIELD OF THE INVENTION

The present invention relates to the field of preparing ink for and during a process of filling ink cartridges or refilling spent ink cartridges. In particular, the present invention relates to a system and method for refilling ink cartridges for ink jet printers comprising at least one of a particle filtration device and a degassing device.

BACKGROUND OF THE INVENTION

Ink jet printers are a popular form of printer used with computers and similar applications involving document printing or graphics preparation. Typical ink jet printers, such as those manufactured by Original Equipment Manufacturers (OEMs) such as Hewlett Packard, have replaceable ink jet cartridges with built-in print heads. While such OEM ink jet cartridges are a convenient manner of supplying ink to such printers, the cartridges are necessarily expensive due to their complexity and the provision of print heads with the cartridges.

Cartridges provided by printer manufacturers are typically not designed to be refilled when the ink supply runs out. It is well known, however, that such cartridges and their associated print heads have useful lives significantly longer than that provided by the initial supply of ink. Therefore, an after-market industry has evolved, that is directed to providing systems for refilling cartridges with ink. The need to provide ink refilling is especially acute in the case of color ink cartridges, because typically one color will run out of ink before the other colors are depleted.

Refilling ink cartridges with ink is not an easy task. First, some means must be provided to supply the ink to the interior of the cartridges. Because the ink reservoirs are typically filled with foam sponge, the ink refilling process is slow due to slow absorption of ink by the foam. Users typically do not have the patience to refill slowly (typically by squeezing a refill reservoir or by gravity feed), and this causes ink to flow into the foam sponge at a rate that is usually too fast to be absorbed. Ink accumulates in the bottom of the cartridge and overflows from the top and from the print head.

To help speed the process, some refilling mechanisms of the prior art pressurize the ink while refilling the cartridge. See, e.g., U.S. Pat. No. 6,945,640 to Cheok, incorporated by reference herein. Such pressurization merely exacerbates an air injection problem, by inducting air along with the ink refilling the cartridge, and by preventing the removal of air from the foam sponge. The air injected into the foam sponge reservoir during refilling causes vapor lock in the ink reservoir. Ink then cannot reach the print head, and the printer fails. In order to overcome this problem, Cheok teaches that the air must subsequently be removed through vacuum evacuation of the cartridge. However, Cheok does not teach how much ink to add to the cartridge.

Prior art refilling mechanisms may not inject the proper quantity of ink into the reservoir. Such overfilling may bind the internal cartridge ink pump, create a mess from weeping ink, and may prevent the cartridge from functioning properly.

In order to avoid vapor lock, U.S. Pat. No. 4,967,207 to Ruder teaches completely evacuating the cartridge, and then supplying ink to refill the cartridge. In essence, Ruder improperly teaches that the vacuum within the cartridge will suck the proper amount of ink back into it. However, it is impossible to achieve a perfect vacuum. If the cartridge could structurally withstand a near perfect vacuum without being damaged, in Ruder's process, the cartridge would be completely filled with ink, and thus would be overfilled. A less than perfect vacuum will not fill the cartridge completely. A properly filled cartridge has a precise quantity of ink, and a certain amount of airspace. Therefore, Ruder does not solve the ink quantity problem.

U.S. Pat. No. 4,968,998 to Allen discloses refilling the cartridge while evacuating, such that the evacuation rate exceeds the filling rate. This Patent states that the cartridge can never be overfilled; however, if the air were completely removed from the cartridge, which would eventually happen by Allen's method, the airspace in the cartridge would no longer exist.

U.S. Pat. No. 5,903,292 to Scheffelin, et al. teaches refilling a spring-loaded collapsible ink bag, which maintains a negative pressure to draw ink into the bag until it is substantially full. However, many commercially available print cartridges are not constructed with such spring loaded bags.

Another prior art solution to these refilling problems is a "Clip-In" type refill system. The original ink cartridge is modified by removing all of the original ink reservoirs, such that only the print heads and the case are left. Removable ink reservoirs are supplied, so the user only has to change the ink reservoir assembly causing no mess. The disadvantage of this system is that it the user must be supplied with a pre-modified cartridge specially-adapted for use only with the removable ink reservoirs, and in practice, this system is nearly as costly as OEM printer cartridges.

Inkjet print heads utilize very fine nozzles for projecting ink from an ink reservoir onto a printable substrate, such as a sheet of paper. The greater the print density, the finer or smaller the size of the nozzle apertures. A contaminated nozzle can impact a print. This is particularly critical when printing large, high quality images, particularly those requiring a large amount of print time for completion, printed on expensive substrates such as canvas, banner material, billboard sign substrates, metals, and the like. This can also impact large sized print batches, where a clogged nozzle can render a portion or an entire print batch as being unacceptable. Contamination can result from entrapped air and particulate matter suspended within the ink.

Thus, there presently exists a need for providing ink having a minimized size and volume of particulate matter and minimizing entrapped air prior to and/or during an ink cartridge filling process.

BRIEF SUMMARY OF THE INVENTION

The present invention provides an automated system for refilling printer ink cartridges. The system includes a computer with memory provided to store information relating to a plurality of ink cartridges, and a user interface that is connected to the computer and can receive a model number of a particular ink cartridge to be refilled. Moreover, the system employs a vacuum chamber with one or more needles provided to add ink into the ink: cartridge. The vacuum chamber is connected to a vacuum pump that draws suction on the vacuum chamber to reduce pressure in the vacuum chamber. In operation, the computer controls the vacuum pump to reduce the pressure in the vacuum chamber to a specific pressure based on the model number of the ink cartridge, and once this pressure is reached, ink is added to the ink cartridge by the needle accordingly.

In one embodiment, the present invention is directed towards a method of refilling a printer ink cartridge, the method comprising steps of:

obtaining an ink dispensing system for transferring ink from an ink reservoir to a the printer ink cartridge, the ink dispensing system comprising:

an ink dispensing element;

an ink pump placed in fluid communication between the ink reservoir and the ink dispensing element;

a degassing filter element integrated in fluid communication between the ink reservoir and the ink dispensing element;

a series of ink supply conduits providing fluid communication between the ink reservoir, the ink pump, the degassing filter element, and the ink dispensing element;

drawing ink from the ink reservoir, wherein the ink pump generates a flow of the ink through the series of ink supply conduits;

passing the ink through the degassing filter element, wherein the degassing filter element removes gas from the ink, converting the ink to a gas reduced ink;

transferring the gas reduced ink to the ink dispensing element;

discharging the gas reduced ink from the ink dispensing element into the printer ink cartridge.

In another aspect, the method further comprises a step of drawing a vacuum upon an interior of the degassing filter element.

In yet another aspect, the ink dispensing system further comprises a second degassing filter element integrated in fluid communication between the first degassing filter element and the ink dispensing element, further comprising a step of:

passing the gas reduced ink through the second degassing filter element, wherein the second degassing filter element removes additional residual gas from the gas reduced ink, converting the gas reduced ink to a further refined gas reduced ink.

In yet another aspect, the ink dispensing system further comprises a second degassing filter element integrated in parallel with the first degassing filter element in fluid communication between the ink reservoir and the ink dispensing element, further comprising a step of:

passing the ink through the first degassing filter element and the second degassing filter element in parallel, wherein first degassing filter element and the second degassing filter element removes gas from the ink, converting the ink to the gas reduced ink.

In yet another aspect, the degassing filter element is arranged between the ink pump and the ink dispensing element further comprising a step of:

passing the ink through the ink pump, then passing the ink through the degassing filter element, wherein degassing filter element removes gas included in the ink from the ink reservoir and additional gas introduced into the ink when the ink passed through the ink pump, converting the ink to the gas reduced ink.

In another embodiment, the present invention is directed to an automated system for refilling an ink cartridge, comprising:

a computer having memory configured to store information relating to a plurality of ink cartridges, the information including a specific pressure designated to refill the ink cartridge;

a user interface coupled to the computer and configured to receive a model number of the ink cartridge;

a vacuum chamber having at least one ink insertion device configured to add ink to the ink cartridge; and a vacuum pump controlled by the computer to reduce the pressure in the vacuum chamber to the specific pressure, and wherein ink is added to the ink cartridge by the at least one ink insertion device when the specific pressure is reached.

In yet another aspect, the automated system further comprises a digital pressure gauge coupled to the computer, wherein the computer further controls the vacuum pump to reduce the pressure in the vacuum chamber in response to a measurement of the digital pressure gauge.

In yet another aspect, the computer further controls the vacuum pump to maintain the pressure in the vacuum chamber as ink is added to the ink cartridge.

In yet another aspect, the vacuum chamber comprises a docking station configured to receive a cartridge cradle, wherein the cartridge cradle is configured to securely hold the ink cartridge.

In yet another aspect, the cartridge cradle is selected based on the model number of the ink cartridge.

In yet another aspect, the cartridge cradle comprises a lid having at least one aperture configured to guide the ink insertion device into the ink cartridge.

In yet another aspect, the ink insertion device is a needle having at least one aperture configured to distribute ink into a foam sponge of the ink cartridge and the lid guides the needle into the foam at an appropriate depth.

In yet another aspect, the cartridge cradle comprises an emptying aperture aligned next to a print head of the ink cartridge.

In yet another aspect, the automated system further comprises an ink cartridge emptying system coupled to the emptying aperture of the cartridge cradle, and configured to remove ink from the ink cartridge.

In yet another aspect, the ink cartridge emptying system comprises: a vacuum pump electronically controlled by the computer; and a filter coupled between the vacuum pump and the aperture of the cartridge cradle, wherein the vacuum pump draws a suction from the filter, thereby removing ink from the ink cartridge.

In yet another aspect, the automated system further comprises a cleaning station configured to ultrasonically clean a print head of the ink cartridge at 28 kilohertz or less.

In yet another aspect, the print head of the ink cartridge is ultrasonically cleaned at a temperature between 60° and 80° Celsius.

In yet another aspect, the amount of ink added to the ink cartridge is based on the model number of the ink cartridge.

In yet another aspect, the present invention is directed to a method for refilling a printer ink cartridge, the method comprising steps of:

placing the cartridge in a vacuum chamber;

reducing pressure in the vacuum chamber to a target reduced pressure respective to the cartridge, the target reduced pressure being between 0.4 to 0.9 millibars below atmospheric;

adding an amount of ink during a first time period while the cartridge is under a vacuum, wherein the vacuum is applied to remove entrapped air from the cartridge;

repeating the adding step until a required amount of ink has been added to the cartridge, wherein a pause between adding steps allows the ink to permeate a foam sponge within the cartridge and provides sufficient time to displace air in the foam.

In another aspect, the adding step further comprises maintaining the pressure in the vacuum chamber.

In yet another aspect ion, the method further comprises providing a docking station for receiving a cartridge cradle securely holding the ink cartridge.

In yet another aspect, the method further comprises selecting the cartridge cradle based on the received model number.

In yet another aspect, the method further comprises guiding the ink insertion device at an appropriate depth, via at least one aperture in a lid of the cartridge cradle, into a foam sponge of the ink cartridge.

In yet another aspect, the method further comprises removing ink from the ink cartridge, by a filter and a vacuum pump, before the adding step.

In yet another aspect, the method further comprises ultrasonically cleaning a print head of the ink cartridge at 28 kilohertz or less.

In yet another aspect, the ultrasonic cleaning step further comprises heating a cleanser at a temperature between 60° and 80° Celsius.

In yet another aspect, the adding step further comprises determining a required amount of ink to be added based on the received model number.

In yet another aspect, the method further comprises repeating the adding step for a plurality of times based on the amount of ink added during a first time period and the required amount of ink.

In yet another aspect, the method further comprises pausing for a time period between adding steps.

In another embodiment, the present invention provides semi-automated or an automated system for refilling wide format printer ink cartridges. The system includes a computer with memory provided to store information relating to each of a plurality of wide format ink printer cartridges.

In this embodiment, the wide format fill ink cartridge refill system comprises:

a controller comprising a computer, a user interface, and ink fill operation software;

a series of ink reservoirs, each ink reservoir containing a volume of ink;

a series of ink fill needles, each needle having a tubular fill conduit having fill end and a distal end, a fill coupler provided at the fill end, a blunt tip formed at the distal end of the fill conduit, and at least one discharge aperture located through a sidewall of the fill conduit and proximate the blunt tip;

a series of ink fill stations, each station comprising a flexible tube having a needle coupler at a distal end for connection of the ink fill needle;

a series of ink pumps, each ink pump providing ink transfer from the respective ink reservoir to a respective ink fill station.

In a second aspect, the present invention overfills the wide format ink cartridge, and then removes a portion of the excess ink to ensure against any entrapped air.

In another aspect, the present invention evacuates a majority of any residual ink prior to filling the cartridge with fresh ink.

In yet another aspect, a vent needle is inserted through a vent port seal of a dual port, wide format cartridge.

While in another aspect, a colorless ink is injected into the cartridge, then a majority of the injected colorless ink is extracted to clean an interior of the ink reservoir.

In another aspect, the cartridge refill system further comprises a station housing comprising a working tray, the working tray comprising a series of apertures and positioned covering a fluid collection basin.

In yet another aspect, a series of needle holders are inserted through the apertures of the working tray.

In yet another aspect of the present invention, the needle comprises two (2) ink-dispensing apertures, one aperture located at 180 degrees from the other.

While, in yet another aspect, the needle comprises three (3) ink-dispensing apertures, each aperture located at 120 degrees from the others.

In yet another aspect, the blunt tip of the needle is formed having an angle between the two edges of the tip of approximately 35 degrees.

In yet another aspect, needle position is adjusted to position the needle ink dispensing aperture(s) proximate a lower edge of the fill port seal prior to an excess ink extraction step.

In yet another aspect, the present invention is directed to a method of filling a wide format cartridge comprises steps of:

inserting an ink fill needle into an ink port seal, the ink fill needle having a blunt tip and ink dispensing apertures on a side of the needle proximate the blunt tip;

overfilling the ink reservoir with ink;

extracting any residual air and a portion of the excess ink;

removing the ink fill needle from the wide format cartridge; and inspecting and testing the refilled cartridge to ensure quality.

In another aspect, the method further comprises the step of extracting old ink from the cartridge.

In yet another aspect, the method further comprises the step of injecting colorless ink into the cartridge to clean the reservoir of any old ink within the cartridge, then extracting the injected colorless ink.

In yet another aspect, a vent needle can be inserted into a vent port of a dual port cartridge form factor to allow air to pass into and from the cartridge reservoir.

In yet another aspect, the method further comprises selecting a program comprising control instructions for filling a specific ink cartridge.

In yet another aspect, the injecting ink step further comprises determining a required amount of ink to be added based on the model number.

In yet another aspect, the method further comprises preferably overfilling the ink cartridge by approximately 5-10% depending upon the cartridge. It is understood the overfilling can actually be set anywhere from 1% on up.

In yet another aspect, the method further comprises pausing for a time period between ink injection steps.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which:

FIG. 3 presents an exemplary chart that illustrates a database schema;

Like reference numerals refer to like parts throughout the several views of the drawings.

DETAILED DESCRIPTION OF THE INVENTION

Figure 1:
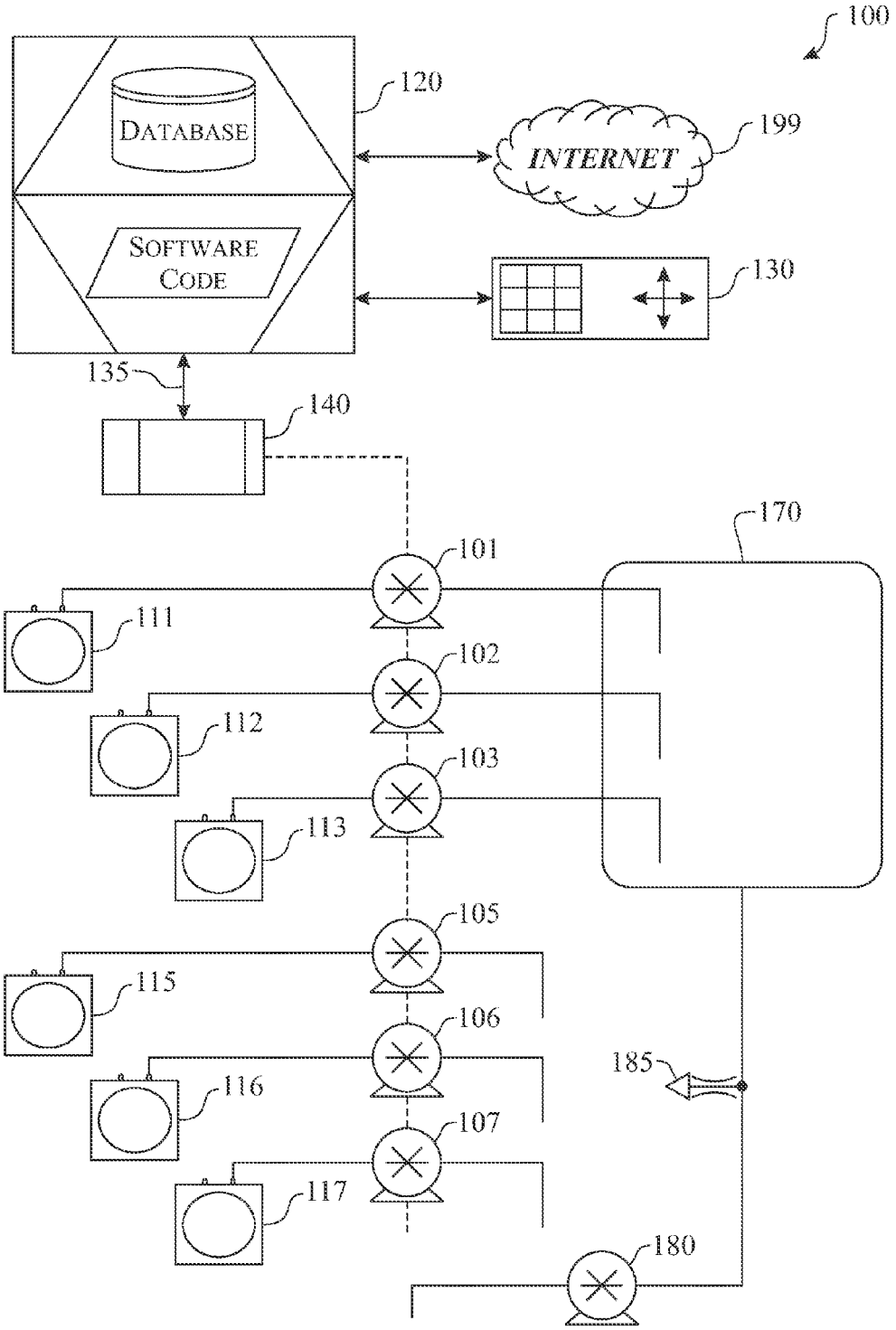
FIG. 1 presents an exemplary block diagram illustrating a system for refilling a printer cartridge.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

The present invention comprises a system for refilling a printer ink cartridge. In a preferred embodiment, the method and system refill the cartridge while the cartridge is under a vacuum to prevent vapor lock. The system preferably comprises a positive displacement, peristaltic ink filling pump that operates under computer control to ensure that the proper amount of ink is added to the cartridge without overfilling the cartridge. The method preferably incorporates filling the cartridge while under vacuum, with pauses between filling events to ensure that air can migrate out of the cartridge. As described below, the filling and pause cycle times are dependent upon the type of cartridge being filled.

The present invention may be described herein in terms of functional block components, code listings, optional selections and various processing steps. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices.

Similarly, the software (program code) elements of the present invention may be implemented with any programming or scripting language such as C, C++, C#, Java, COBOL, assembler, PERL, or the like, with the various algorithms being implemented with any combination of data structures, objects, processes, routines or other programming elements. The system preferably incorporates software modules preferably programmed in Visual C and Visual Basic. Any computer having an operating system using Microsoft Windows 95 or newer can execute the object code created.

Further, it should be noted that the present invention may employ any number of conventional techniques for data transmission, signaling, data processing, network control, and the like.

It should be appreciated that the particular implementations shown and described herein are illustrative of the invention and its best mode and are not intended to otherwise limit the scope of the present invention in any way. Indeed, for the sake of brevity, conventional data networking, and application development and other functional aspects of the systems (and components of the individual operating components of the systems) may not be described in detail herein. Furthermore, the connecting lines shown in the various figures contained herein are intended to represent exemplary functional relationships and/or physical or virtual couplings between the various elements. It should be noted that many alternative or additional functional relationships or physical or virtual connections might be present in a practical electronic data communications system.

As will be appreciated by one of ordinary skill in the art, the present invention may be embodied as a method, a data processing system, a device for data processing, and/or a computer program product. Accordingly, the present invention may take the form of an entirely software embodiment, an entirely hardware embodiment, or an embodiment combining aspects of both software and hardware. Furthermore, the present invention may take the form of a computer program product on a computer-readable storage medium having computer-readable program code means embodied in the storage medium. Any suitable computer-readable storage medium may be utilized, including hard disks, CD-ROM, optical storage devices, magnetic storage devices, and/or the like.

The present invention is described below with reference to block diagrams and flowchart illustrations of methods, apparatus (e.g., systems), and computer program products according to various aspects of the invention. It will be understood that each functional block of the block diagrams and the flowchart illustrations, and combinations of functional blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, functional blocks of the block diagrams and flowchart illustrations support combinations of means for performing the specified functions, combinations of steps for performing the specified functions, and program instruction means for performing the specified functions. It will also be understood that each functional block of the block diagrams and flowchart illustrations, and combinations of functional blocks in the block diagrams and flowchart illustrations, can be implemented by either special purpose hardware based computer systems that perform the specified functions or steps, or suitable combinations of special purpose hardware and computer instructions.

One skilled in the art will also appreciate that, for security reasons, any databases, systems, or components of the present invention may consist of any combination of databases or components at a single location or at multiple locations, wherein each database or system includes any of various suitable security features, such as firewalls, access codes, encryption, de-encryption, compression, decompression, and/or the like.

The scope of the invention should be determined by the appended claims and their legal equivalents, rather than by the examples given herein. For example, the steps recited in any method claims may be executed in any order and are not limited to the order presented in the claims. Moreover, no element is essential to the practice of the invention unless specifically described herein as "critical" or "essential."

An exemplary block diagram illustrating a preferred embodiment for a computer ink cartridge refilling system 100 is presented in FIG. 1. The computer ink cartridge refilling system 100 includes a computer 120 and a touch screen 130. The computer 120 includes a microprocessor, a user interface (such as the touch screen 130), a digital memory storage device, software program code 150 which provides an instruction set to the microprocessor and a respective database 125. As shown, the computer 120 is interfaced with the Internet 199 via a respective communications interface such as a NIC card, WiFi interface, a modem, and the like. Communications between the computer 120 and the troubleshooting facilities may be physically facilitated through wired (cable, fiber-optic, T1 lines, and the like) or wireless links on which electronic signals can propagate, and may be embodied, for example, as (i) a dedicated wide area network (WAN), (ii) a telephone network, including the combination of local and long distance wire or wireless facilities and switches known as the public switched telephone network ("PSTN"), or (iii) the Internet 199.

The computer 120 is preferably interfaced through an RS-232 serial port to the relay board 140 via the communications cable 135. Under the control of the computer 120, the relay board 140 supplies power to various motors to control the operation of the attached pumps. These pumps are color ink pumps 101-103, comprising yellow 101, cyan 102, and magenta 103, a waste pump 105, a cleaning pump 106, and a black ink pump 107, as illustrated in FIG. 1. Each ink pump draws ink from an associated reservoir, yellow 111, cyan 112, magenta 113 and black 117 and supplies the ink via a needle inserted into the cartridge. Preferably, each pump is a positive displacement, peristaltic pump that can be run in the reverse direction, so that residual ink can be removed from the line and returned to the reservoir. The waste pump 105 draws liquid from the cartridge into a waste reservoir 115. The cleaning pump 106 supplies a cleaning solvent drawn from the associated reservoir 116 to the cartridge via a needle inserted into the cartridge.

The ink lines from the color ink pumps 101, 102, 103 run through the wall of a vacuum chamber 170. The associated needle may be inserted into the cartridge to be refilled. The vacuum chamber 170 has a door that can be opened to place the cartridge within the chamber. Preferably, the door seats on a sealing surface of the chamber.

Air from the vacuum chamber 170 is removed by the vacuum pump 180. As air is removed from the chamber, the door and sealing surface seals the vacuum chamber so that an appropriate vacuum can be drawn. The vacuumstat 185 controls the amount of vacuum that the pump 180 draws on the chamber 170.

Figure 2:
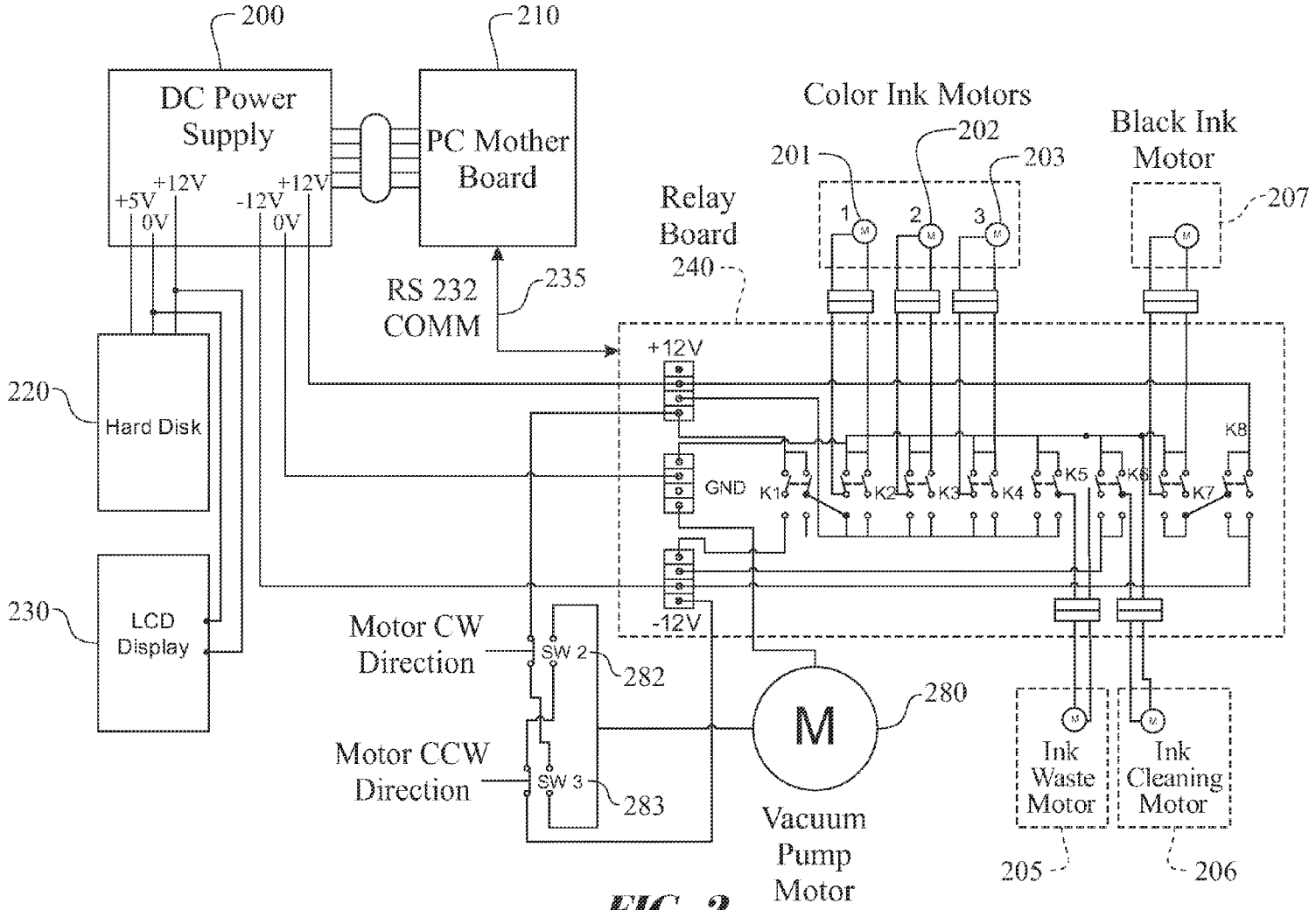
FIG. 2 presents an exemplary schematic wiring diagram for the printer cartridge ink refilling system.

An exemplary schematic wiring diagram for the printer cartridge ink refilling system is presented in FIG. 2. As illustrated, a direct current (DC) power supply 200 provides power to a personal computer (PC) motherboard 210, a hard disk 220, and a Liquid Crystal Display (LCD) 230. The DC power supply 200 also provides positive and negative 12 VDC power to a relay board 240. The relay board 240 is connected to the PC motherboard 210 via an RS-232 communications link 235. The relay board 240 provides 12 VDC of opposite polarities to the motors 201-203, 205-207 via the relays K1-K8 to run the motor in either direction. The switches 282, 283 provide power to the vacuum pump motor 280 to run this motor in either direction.

A chart illustrating an exemplary database schema 300 is presented in FIG. 3. The database 300 preferably stores information respective to different printers and their associated cartridges that are to be refilled. The database 300 maintains a plurality of records, such that each of the records 305-320 is associated with a type of printer and the print cartridge used in that printer. For each cartridge identified by a cartridge model number in field 330, the database 300 includes a required amount of ink to refill the cartridge in field 335. Preferably, this amount is determined by weighing an empty cartridge and a brand new cartridge. The difference in weight times the density of the ink equals the volumetric amount of ink that must be added to the cartridge in order to refill it.

In addition, the database 300 preferably includes fields for a length of time that the ink pump should be run and a length of time the ink pump should pause, during each filling cycle, in fields 340 and 345, respectively. Such fields may or may not have been part of the database schema, but may also be coded into the software program code 150.

The following discussion describes the methods performed by the inventive system. To provide context, the operation of an exemplary, preferred embodiment of the software program code 150 is described in conjunction with FIGS. 4 and 5.

Figure 4:
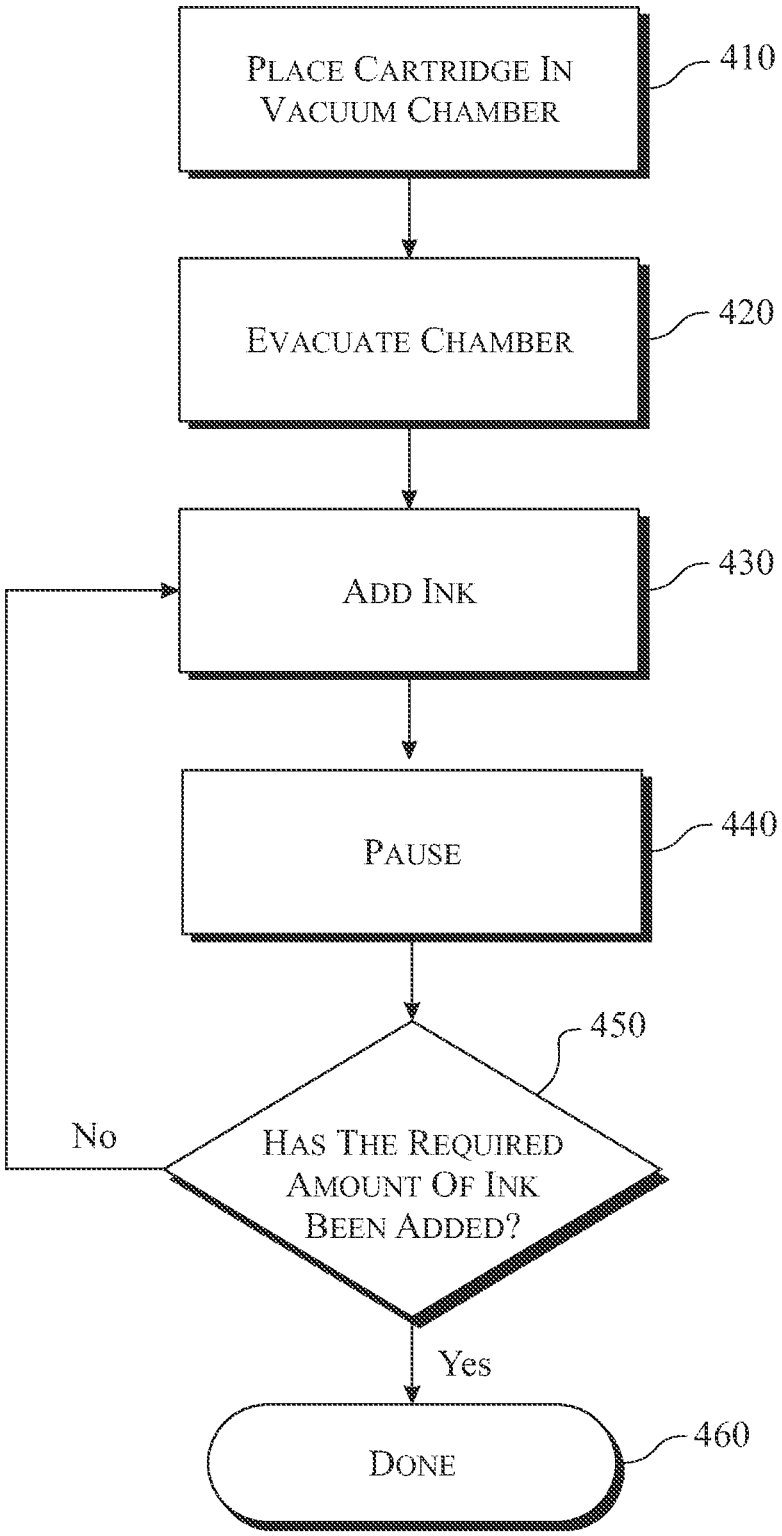
FIG. 4 presents an exemplary flow chart illustrating a series of acts for refilling a printer cartridge.
Figure 5:
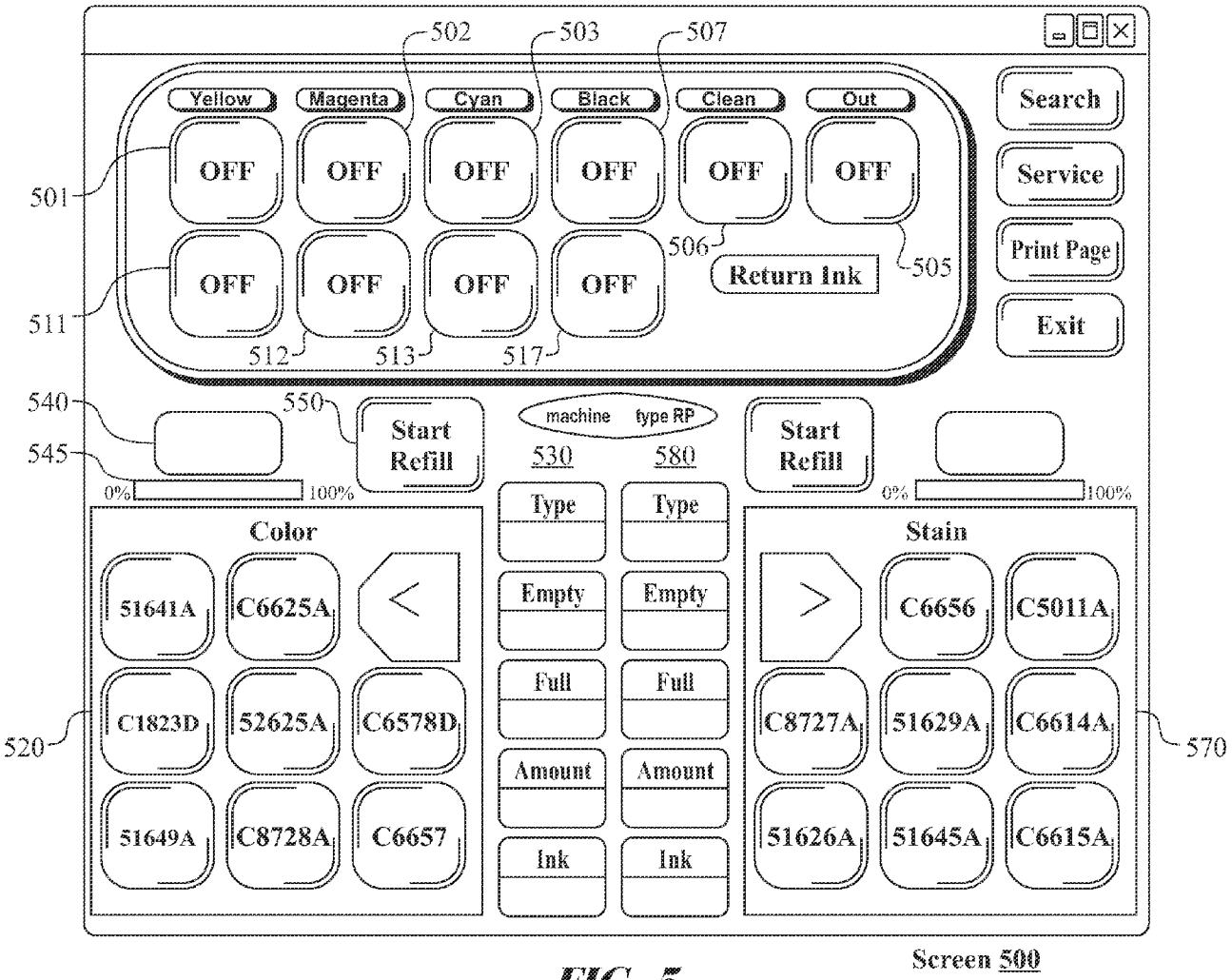
FIG. 5 presents an exemplary diagram illustrating a control screen for the refilling system.

A flow chart illustrating a series of acts for refilling a printer cartridge using system 100 is presented in FIG. 4. As illustrated, in step 410, a color cartridge being filled is placed into the vacuum chamber 170. The user will provide an indication to the system 100 that a particular cartridge is being refilled. This identification is described below in connection with FIG. 5.

Before the cartridge is filled, the user must determine whether the cartridge is empty. The preferred way to make this determination is to weigh the cartridge. If the cartridge weighs more than two (2) grams above an empty weight, then the cartridge most likely contains residual ink, which should be removed. Preferably, the user can pump the residual ink out of the cartridge. If the ink cannot be removed in this fashion, then the cartridge is preferably placed in a centrifuge to remove the residual ink. In addition, dried ink may not be removed, so a cleaning solved may be necessary, which can be pumped into the cartridge, and then removed. Alternatively, the user may clean the cartridge in an ultrasonic cleaner. Additionally, the print head of the cartridge may be reconditioned by steam cleaning.

In step 420, the user places the clean, empty cartridge into the vacuum chamber 170 and inserts the filling needles into the cartridge. The user manually activates the vacuum pump 180, which will reduce the pressure in the chamber down to the setting provided on the vacuumstat 185. Preferably, the vacuumstat 185 is set to control pressure in the vacuum chamber 170 to between 0.4 to 0.9 millibars below atmospheric. More preferably, the vacuumstat 185 is set to control and maintain pressure in the vacuum chamber 170 to about 0.7 millibars below atmospheric.

In step 430, the user initiates the automatic refilling process. Preferably, software program code 150 causes computer 120 to communicate with relay board 140 to run ink filling pump 101-103 to add ink to the cartridge. The ink is added in discrete filling steps. Computer 120 preferably runs pump 101-103 for a brief period of time, defined either in software program code 150, or as specified in database 300.

In step 440, the computer 120 pauses the running pump 101-103 so that the ink will permeate the foam sponge within the cartridge. As the ink displaces air in the foam, the vacuum pump 180 removes the air. In a preferred embodiment, the amount of time that the pumps are paused is longer than the amount of time that they are run, so that the air can be more effectively removed.

In step 450, the computer 120 determines whether the required amount of ink has been added to the cartridge. Because the ink pump is preferably a positive displacement pump, the volume of ink added is directly proportional to the amount of time that the pump 101, 102, 103 is run. The computer 120 calculates whether the required amount of ink has been added, and if not, the computer 120 repeats steps 430 and 440. The number of times that the computer 120 must repeat these steps is preferably based on the required amount of ink to add to the cartridge divided by the amount of ink added during step 430.

In step 460, the computer 120 has added the required amount of ink to the cartridge, and indicates that the automatic refilling process is complete.

The user can then release the vacuum in the chamber 170 by running the vacuum pump 180 in the reverse direction, open the door to the vacuum chamber 170 and remove the cartridge.

The user also has the ability to operate other pumps from the touch screen 130. A diagram illustrating a control screen 500 for the refilling system is presented in FIG. 5. As illustrated, several screen-based buttons are provided so that the user may manually control each pump in the system 100, and may also initiate a refilling process. When activated, the buttons 501, 502, 503 cause the computer 120 to run the yellow, cyan and magenta pumps 101, 102, 103, respectively, in the fill direction. The buttons 505, 506, 507 run the waste, cleaning solution and black ink pumps 105, 106, 107, respectively, in the supply direction. The buttons 511, 512, 513 and 517 run yellow, cyan, magenta and black ink pumps 101, 102, 103, and 107, respectively in the return direction, so that their respective lines can be drained of ink.

The button group 520 permits the user to select a particular type of color ink cartridge that will be refilled. The column 530 provides indicators for the selected cartridge, such as the cartridge type, weight when empty, weight when full, amount of ink required to fill it, and the type of ink. Likewise, the button group 570 identifies numerous types of black ink cartridges that may be selected for refilling. The selected cartridge information similarly appears in column 580.

The button 550 initiates the automatic refilling process described above in connection with FIG. 4. When the user activates this button, the indicators 540, 545 report the progress of the refilling process. Indicator 540 reports the amount of ink that has been added to the cartridge. Indicator 545 reports the percentage filled. Similar indicators are provided for refilling black ink cartridges.

Figure 6:
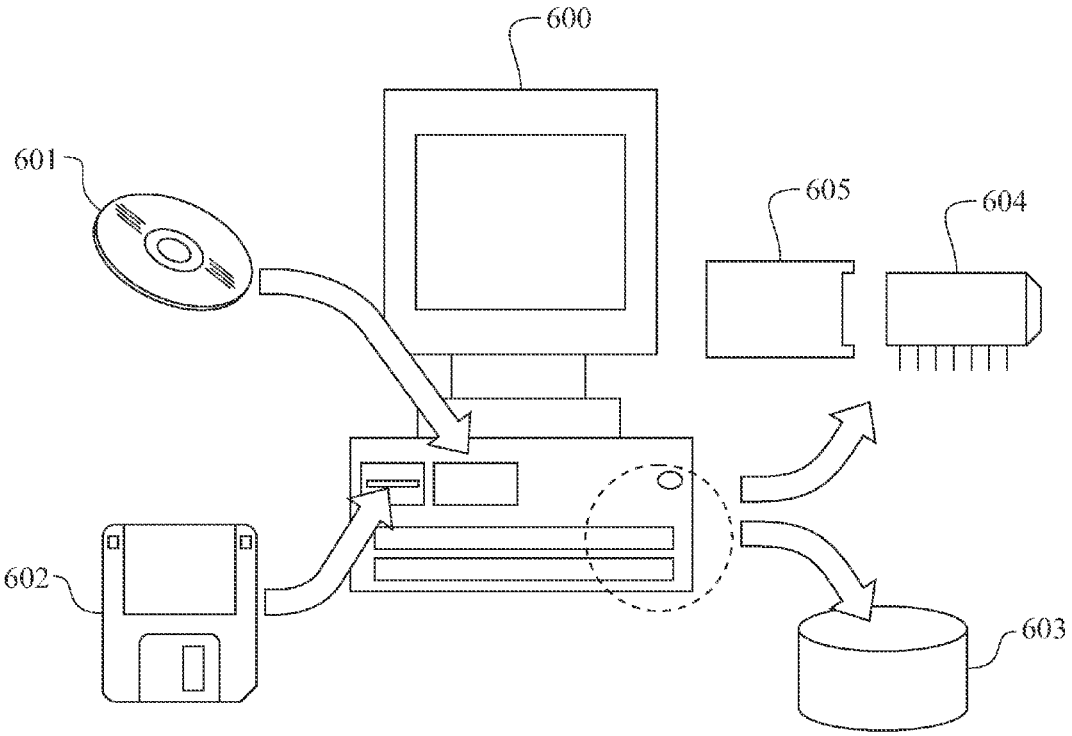
FIG. 6 presents examples of recording media.

In the specification, the term "media" means any medium that can record data therein. Examples of recording media are illustrated in FIG. 6.

The term "media" includes, for instance, a disk shaped media form 601 such as a CD-ROM (compact disc-read only memory), a magneto optical disc or MO, a digital video disc-read only memory or DVD-ROM, a digital video disc random access memory or DVD-RAM, a floppy disc 602, a memory chip 604 such as random access memory or RAM, read only memory or ROM, erasable programmable read only memory or E-PROM, electrical erasable programmable read only memory or EE-PROM, a rewriteable card-type read only memory 605 such as a smart card, a magnetic tape, a hard disc 603, a USB memory stick (not shown, but well understood by those skilled in the art) and any other suitable means for storing a program therein.

A recording media storing a program for accomplishing the above mentioned apparatus maybe accomplished by programming functions of the above-mentioned apparatuses with a programming language readable by a computer 600 or processor, and recording the program on a media such as mentioned above.

A server equipped with a hard disk drive may be employed as a recording media. It is also possible to accomplish the present invention by storing the above mentioned computer program on such a hard disk in a server and reading the computer program by other computers through a network.

It is understood that any suitable device for performing computations in accordance with a computer program may be used for the computer processing device 600. Examples of such devices include a personal computer, a laptop computer, a microprocessor, a programmable logic device, a computing tablet, or an application specific integrated circuit.

In accordance with the foregoing description, the present invention provides the following advantages:

Because the ink filling process is completely automated, the reliability of the refilled cartridge is greatly improved.

By using a positive displacement pump, the computer 120 can precisely control the amount of ink that is added to the cartridge to prevent problems caused by overfilling the cartridge.

By filling the cartridge while it is under a vacuum, air binding problems are eliminated.

Figure 7:
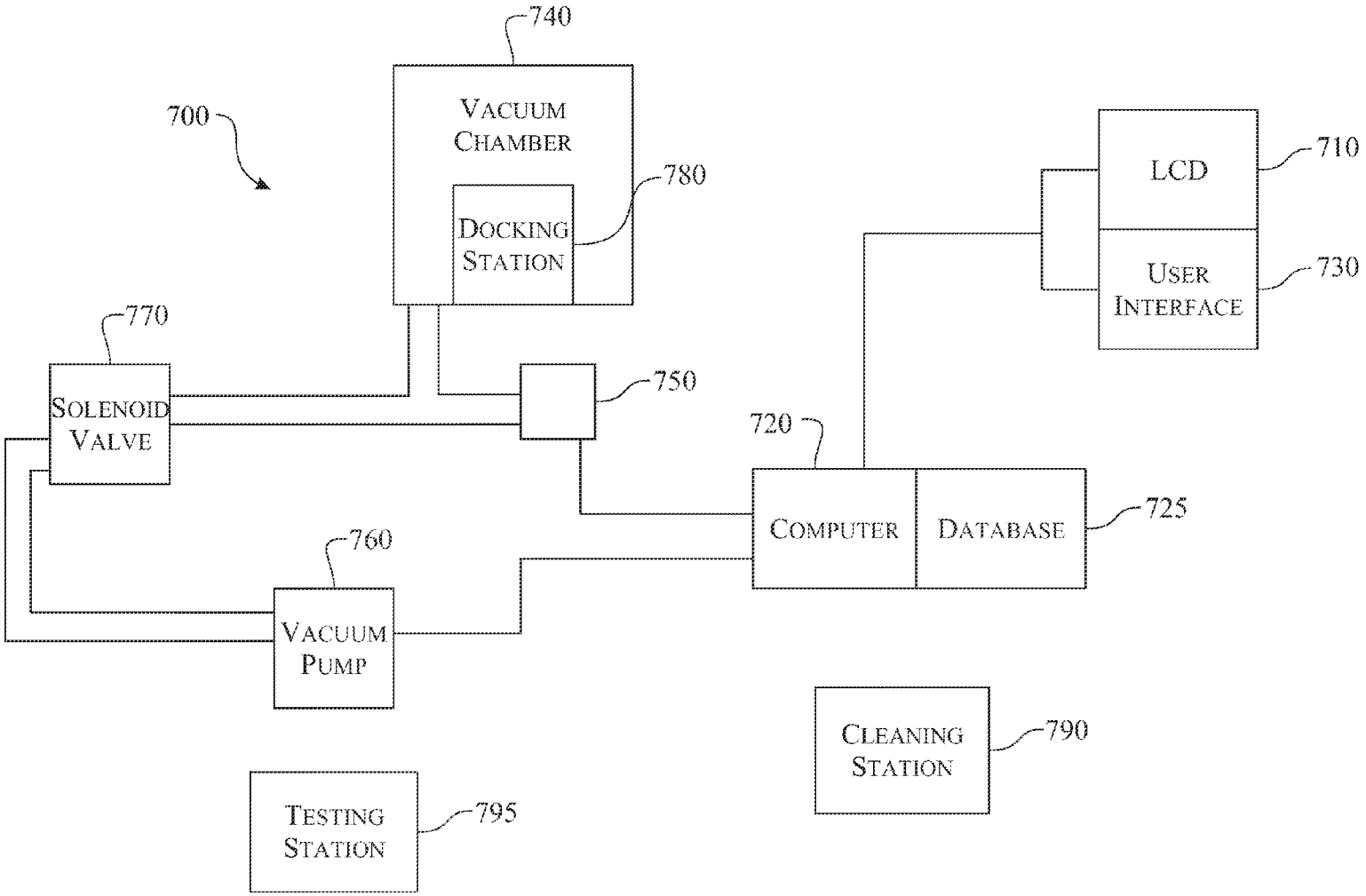
FIG. 7 presents an exemplary block diagram of an automated ink cartridge refilling system in accordance with another exemplary embodiment of the present invention.

A representative block diagram of an automated ink cartridge refilling system 700 in accordance with another exemplary embodiment of the present invention is presented in FIG. 7. It is noted that some of the elements of the automated ink cartridge refilling system 700 functions similarly to those employed by the system described above with respect to FIGS. 1 through 6. For example, automated ink cartridge refilling system 700 comprises a user interface 730 provided to receive user input to control the refilling process. The user interface 730 may be a graphical user interface (GUI), a keyboard, a touch screen, a mouse, a trackball, a touchpad, or any other similar device. Moreover, an LCD display 710 is provided to display or visually present necessary information to the user. Of course it should be understood to those skilled in the art that the user interface 730 and the LCD display 710 may be a single component such as a touch screen activated GUI. Furthermore, both the user interface 730 and the LCD display 710 are provided in signal communication with a computer 720, which comprises a database 725 and software program code.

As previously discussed with respect to FIG. 3 and the database 300, the database 725 maintains a plurality of records associated with a type of printer and the print cartridge used in that printer. Moreover, a user is able to input cartridge identifying information to facilitate the refill process using computer ink cartridge refilling system. In a further embodiment of the present invention, the cartridge identifying information can be the model number of the ink cartridge to be refilled.

In addition, the automated ink cartridge refilling system 700 comprises a vacuum chamber 740, a digital pressure gauge 750 and a vacuum pump 760. The vacuum chamber 740 employs a door that can be opened to place an ink cartridge within the chamber. Air from the vacuum chamber 740 is removed by the vacuum pump 760. Moreover, the digital pressure gauge 750 can read the pressure within vacuum chamber 740 and relay this information to computer 720. It is further noted that in alternative embodiments, multiple vacuum chambers may be employed by the automated ink cartridge refilling system 700.

In operation, once a user inputs the model number of the ink cartridge that is to be refilled on the user interface 730, the computer 720 looks up the model number in the database 725 to determine the associated ideal pressure for the specific ink cartridge to be refilled. Accordingly, once the cartridge is placed in the vacuum chamber 740 and its door is closed, effectively sealing the chamber, the computer 720 sends an activating signal to the vacuum pump 760 to begin reducing the pressure in the vacuum chamber 740. The digital pressure gauge 750 may further ascertain a digital measurement of the pressure in the vacuum chamber 740 and relay this information to the computer 720. As a result, the automated ink cartridge refilling system 700 is able to maintain a precise pressure within the vacuum chamber 740 as prescribed by the database 725. Furthermore, once the refill process begins and ink is added to the cartridge, the pressure in the vacuum chamber 740 changes. As this ink is added, the computer 720 is able to recalibrate the pressure in the vacuum chamber 740 based on the read out from the digital pressure gauge 750.

Finally, it should be understood that a valve or the like may be necessary to maintain the pressure in the vacuum chamber 740. In the exemplary embodiment, a solenoid valve 770 is positioned between the vacuum pump 760 and the vacuum chamber 740. The computer 720 may be coupled to the solenoid valve 770 in order to control whether the valve 770 is positioned in an open state or in a closed state. For example, the computer 720 will control the solenoid valve 770 to be open while the vacuum pump 760 is operating such that the pressure can be reduced accordingly.

In yet another embodiment of the invention, the vacuum chamber 740 comprises a docking station 780, which is configured to receive a cartridge cradle (not shown) to facilitate the refill process. In particular, the automated ink cartridge refilling system 700 may be accompanied by a plurality of cartridge cradles provided to hold different models of ink cartridges. As will be described below with respect to FIGS.

8*a* and 8*b*, each cartridge cradle is provided to facilitate the refill of one or more cartridges. Accordingly, when a user inputs the model number of the ink cartridge to be refilled, via the user interface 730, the LCD display 710 will indicate to the user the particular cradle that should be used for that ink cartridge. This information can be stored in the database 725. Moreover, each of the plurality of cradles can be labeled with a particular identification, such as a number, to facilitate the process. Once the ink cartridge is secured in the cartridge cradle 800, the cartridge cradle 800 can in turn be secured in the docking station 780 within the vacuum chamber 740. It is noted that while the specific structural features of the docking station 780 are not shown, the docking station 780 is designed to receive the cartridge cradle, such as that illustrated in FIG. 8*b*.

As an additional feature, automated ink cartridge refilling system 700 further comprises a cleaning station 790, which is provided to clean the ink cartridge print head before and/or after it has been refilled. Specifically, the user may clean the cartridge in a heated ultrasonic cleaner operating at a frequency of 28 kilohertz or less. In one embodiment, the ultrasonic cleaner may be heated to between 60° and 80° Celsius. Moreover, one or more testing stations 795 may be provided to electronically test the ink cartridge before the refill process to ensure the ink cartridge is functional. The testing station 795 enables the user to verify the operability of the ink cartridge before ink is added during the refill process, saving time and money if the ink cartridge is in fact inoperable. It is noted that when multiple testing stations are provided, the database 725 may maintain information defining which testing station should be used based on the particular model number of the ink cartridge.

Figure 8A:
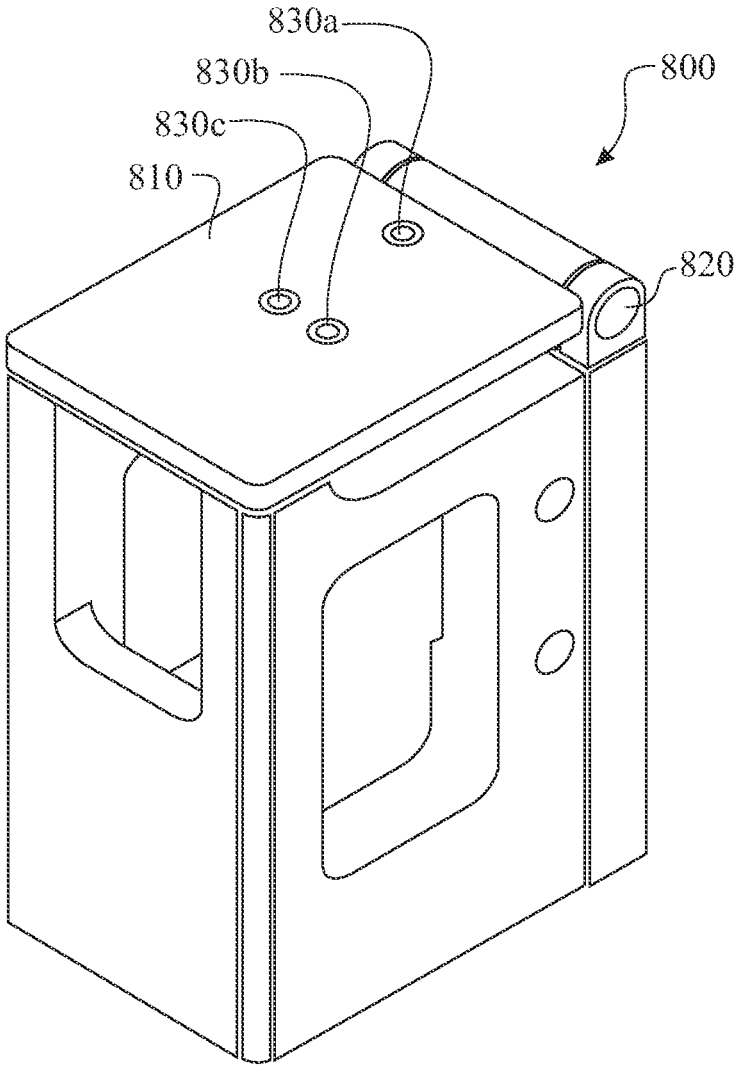
FIG. 8*a* presents an exemplary cartridge cradle in accordance with an exemplary embodiment of the present invention.

An exemplary cartridge cradle is illustrated in FIG. 8*a*. As noted above, the cartridge cradle 800 is provided to securely hold the ink cartridge during the refill process. As shown, the cartridge cradle 800 comprises a lid 810 that can be opened to insert an ink cartridge. The lid 810 may be coupled to the cartridge cradle 800 employing a hinge 820 or any other suitable connecting device. Furthermore, the cartridge cradle 800 comprises internal clips (not shown) that are configured to secure the ink cartridge. It should be understood that different cartridge cradles of the plurality as discussed above might comprise differently shaped clips to secure the different type of ink cartridges that may be refilled. Accordingly, the design of the clips will be based on the shape of the respective ink cartridge.

In addition, the cartridge cradle 800 comprises an aperture (not shown) at its lower panel (opposite lid 810), which is positioned to align adjacent to the ink cartridge print head. As will be discussed in more detailed below, this aperture is provided as part of a suction process to remove old ink from the ink cartridge before fresh ink is added during the refill process.

Figure 8B:
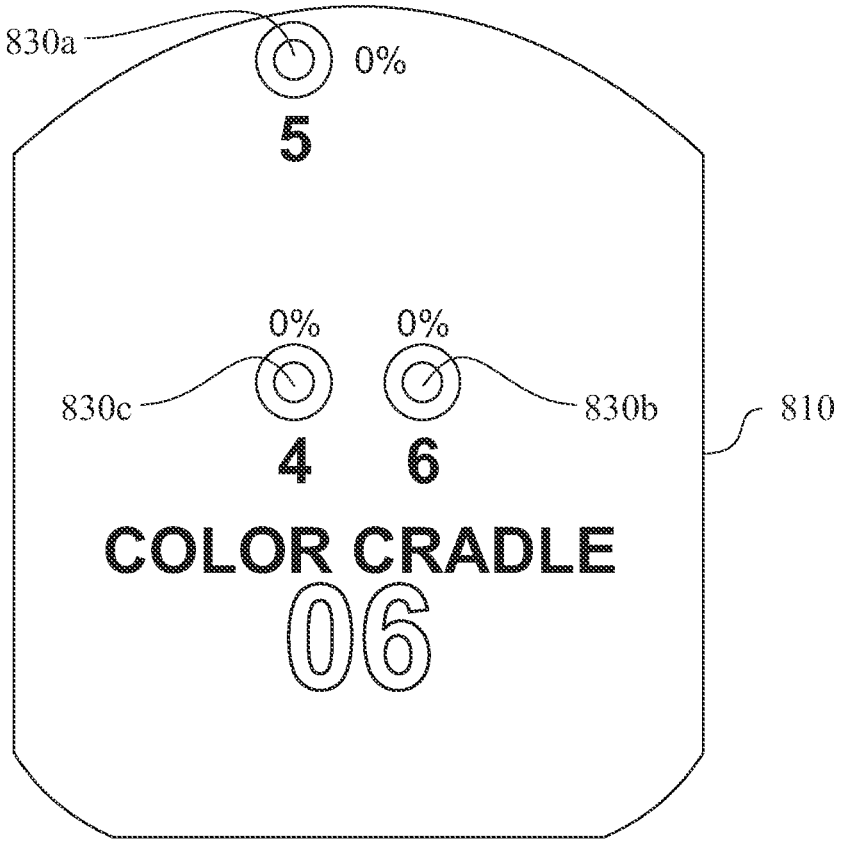
FIG. 8*b* presents an exemplary lid of cartridge cradle in accordance with an exemplary embodiment of the present invention.

An exemplary embodiment of lid 810 is illustrated in FIG. 8*b*. As shown, lid 810 includes identifying information, such as the number "06". As noted above, once the user inputs a model number, the LCD display 710 will indicate to the user which ink cradle must be used to refill that particular cartridge.

Moreover, the lid 810 comprises three apertures 830*a*, 830*b*, and 830*c*. As discussed above, needles associated with color ink pumps 101, 102, 103 may be inserted into the cartridge to enable the refill process. In this embodiment, apertures 830*a*, 830*b*, and 830*c* are configured to guide the insertion of the respective needles into the ink cartridge, and more specifically, into the foam bodies of the ink cartridge, which are provided to retain the particular type of ink: (e.g., cyan, magenta, yellow, etc.). It should be further understood that the position of apertures 830*a*, 830*b*, and 830*c* vary based on the different cartridge cradles employed to refill the different types of ink cartridges.

For example, as shown in FIG. 8*b*, apertures 830*a*, 830*b*, and 830*c* are identified by numbers "4", "5", and "6" respectively. These numbers correspond to the respective needles that should be used to refill the foam bodies of the given cartridge. In another embodiment, apertures 830*a*, 830*b*, and 830*c* may also be designated by colors that correspond to the actual ink color that is to be added by the respective needles. For example, if the aperture 830*a* corresponds to yellow ink, the aperture 830*a* will have a yellow ring around it, indicating that the needle providing the yellow ink should be inserted accordingly. Providing these designations simplifies the process for the user to insert needles into the ink cartridge.

The cartridge cradle 800 and the lid 810 are also arranged such that the lid 810 maintains a predefined distance from the ink cartridge once it is secured. To achieve the best results during the ink cartridge refilling process, ink should preferably be added close to the bottom of the foam body, i.e., close to the ink cartridge print head. As ink is added, it slowly permeates upwards through the foam body. Accordingly, if the needle is not inserted far enough into the foam body, ink will not permeate evenly throughout the foam body. Moreover, it is important not to puncture the screen at the bottom of the foam body that is connected to the ink cartridge print head. Damaging the screen would inhibit the performance of the ink cartridge. By employing the lid 810 and designing the length of the needles such that they can only be inserted a certain distance into the ink cartridge, via the apertures 830*a*, 830*b*, and 830*c*; the ink is dispersed close to the bottom of the foam body. In one further embodiment, the opening(s) of the needles may be at the side of the needle rather than at its tip, which facilitates ink dispersion in a horizontal direction rather than a downward direction. Such design helps avoid ink overflow at the ink cartridge print head.

Finally, it is noted that some ink cartridges do not have predefined holes for the insertion of needles to add ink as part of a refill process. As such, the cartridge cradle 800 stabilizes the ink cartridge and the apertures 830*a*, 830*b*, and 830*c* can further provide a guide for a hand drill to drill holes into the ink cartridge before refill (if necessary). Again, the hand drill can be designed to a certain length such that it does not damage the screen at the bottom of the foam bodies in the ink cartridge.

As discussed above, the cartridge cradle 800 comprises an emptying aperture (not shown) at its lower panel (opposite of the lid 810), which facilitates the removal of old ink from the ink cartridge before fresh ink is added during the refill process. This emptying aperture is aligned adjacent to the ink cartridge print head. In addition, the docking station 780 may comprise a similarly situated aperture that is aligned next to the aperture of the cartridge cradle 800. These emptying apertures enable an ink cartridge emptying system to draw suction from the ink cartridge print head to remove the old ink accordingly.

Figure 9:
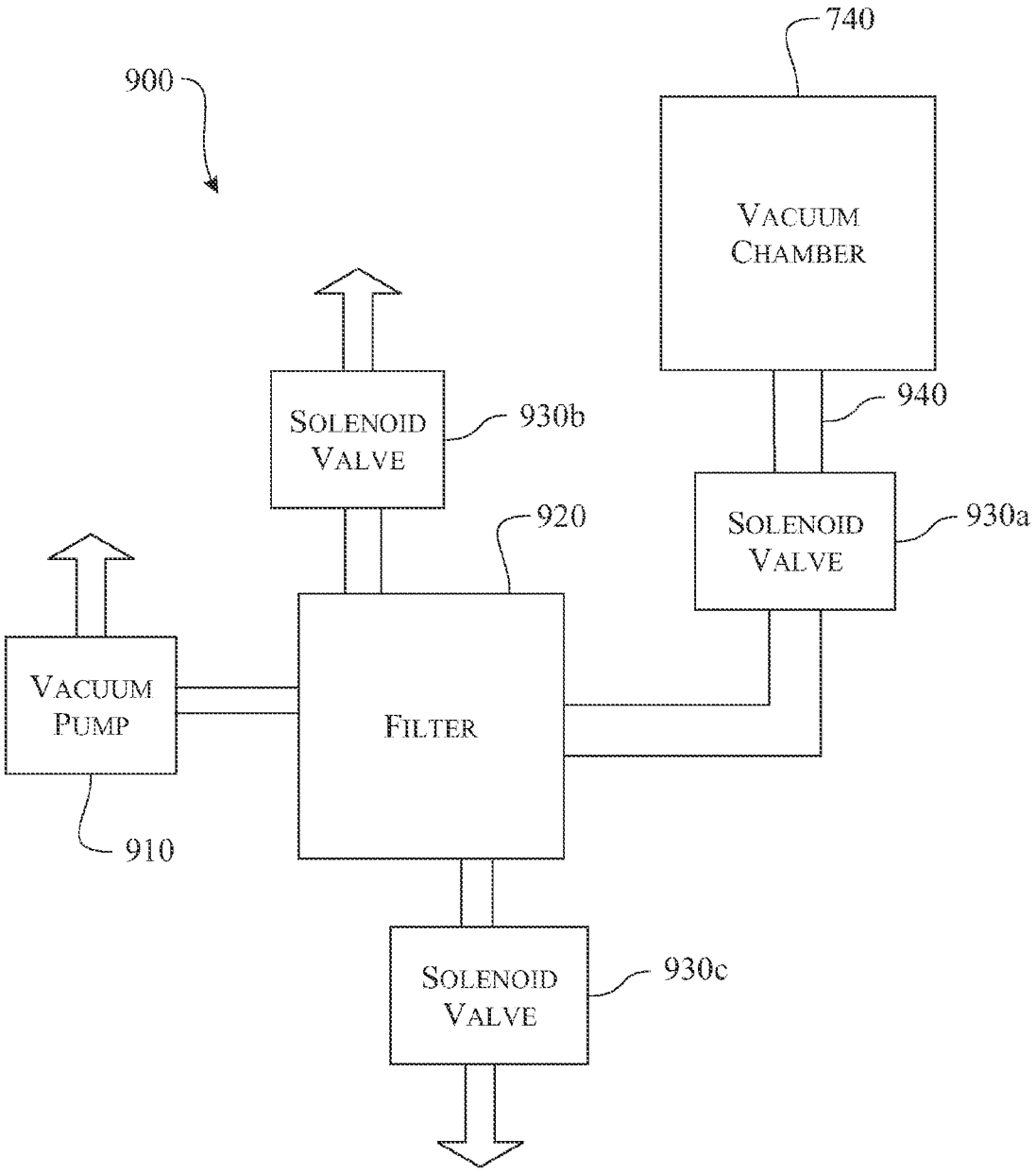
FIG. 9 presents an exemplary block diagram of an ink cartridge emptying system.

An exemplary block diagram of an ink cartridge emptying system 900 is presented in FIG. 9. It should be understood that the ink cartridge emptying system 900 is employed in conjunction with the automated ink cartridge refilling system 700 illustrate in FIG. 7. Once the ink cartridge emptying system 900 has removed all of the old ink from the ink cartridge, the automated ink cartridge refilling system 700 can subsequently refill the ink cartridge with fresh ink as discussed above.

As shown, the ink cartridge emptying system 900 comprises a vacuum pump 910, a filter 920 and solenoid valves 930*a*, 930*b*, and 930*c*. The vacuum pump 910 is coupled to the filter 920 and has an input to draw suction from the filter 920. Additionally, the vacuum pump 910 outputs air flow to the atmosphere. Such components are well known to those skilled in the art. In the preferred embodiment, the vacuum pump 910 is a compressor, such as an axial-flow compressor, a centrifugal compressor, or the like.

Furthermore, the filter 920 comprises an output, which serves as the input to the vacuum pump 910 as well as an input that is coupled to the vacuum chamber 740 via tubing. The solenoid valve 930*a* may be positioned between the vacuum chamber 740 and the filter 920 as shown. Moreover, the tubing 940 above the solenoid valve 930*a* is connected to the aperture of the docking station 780 as discussed above.

In addition, the top and bottom sections of the filter 920 each have an opening to the atmosphere. Both opening are controlled by solenoid valves 930*b* and 930*c*, respectively. Although not shown, the vacuum pump 910 and all three solenoid valves 930*a*, 930*b*, and 930*c* can be controlled by the computer 720.

In operation, once a user has secured the ink cartridge in cartridge cradle 800 and has then secured cartridge cradle 800 in the docking station 780, the ink cartridge emptying system 900 can initiate the ink emptying process via an emptying aperture. Specifically, the computer 720 transmits electronic signals to the solenoid valves 930*a*, 930*b*, and 930*c* to open the solenoid valve 930*a* and close solenoid valves 930*b* and 930*c*. Subsequently, the computer 720 causes the vacuum pump 910 to draw suction from the filter 920, which in turn draws suction from the emptying aperture of the docking station 780. As a result of the suction, old ink is withdrawn from the ink cartridge and drains into the filter 920. The computer 720 causes the vacuum pump to operate for a predefined amount of time. In the preferred embodiment, this process continues for approximately two (2) minutes. However, any time may be used that sufficiently ensures that all of the old ink is removed from the ink cartridge. Once complete, the computer 720 sends an electronic signal to the solenoid valve 930*a* to switch to a closed state. At that point, the ink refilling process to add fresh ink can begin as discussed above. Moreover, the computer 720 can send electronic signals to solenoid valves 930*b* and 930*c* to switch to an open state to drain the filter 920 accordingly.

It is further noted, that while the above-described ink cartridge emptying system 900 is only illustrated as being coupled to one vacuum chamber, i.e., the vacuum chamber 740, in alternative embodiments, the ink cartridge emptying system 900 may be provided to empty ink cartridges positioned in multiple vacuum chambers. Furthermore, the ink cartridge emptying system 900 may be employed to empty additional filling stations that will now be described.

Specifically, in addition to vacuum chambers, the automated ink cartridge refilling system 700 may further comprise ink filling stations configured to refill black ink cartridges. It is noted that it is not necessary to refill black ink cartridges in a vacuum chamber due to the viscosity characteristics of the currently available black ink. Of course, the application is in no way intended to be limited to refilling color cartridges in the vacuum chamber 740 as described above. In alternative embodiments, the vacuum chamber 740 is configured to refill ink cartridges containing black ink.

Figure 10A:
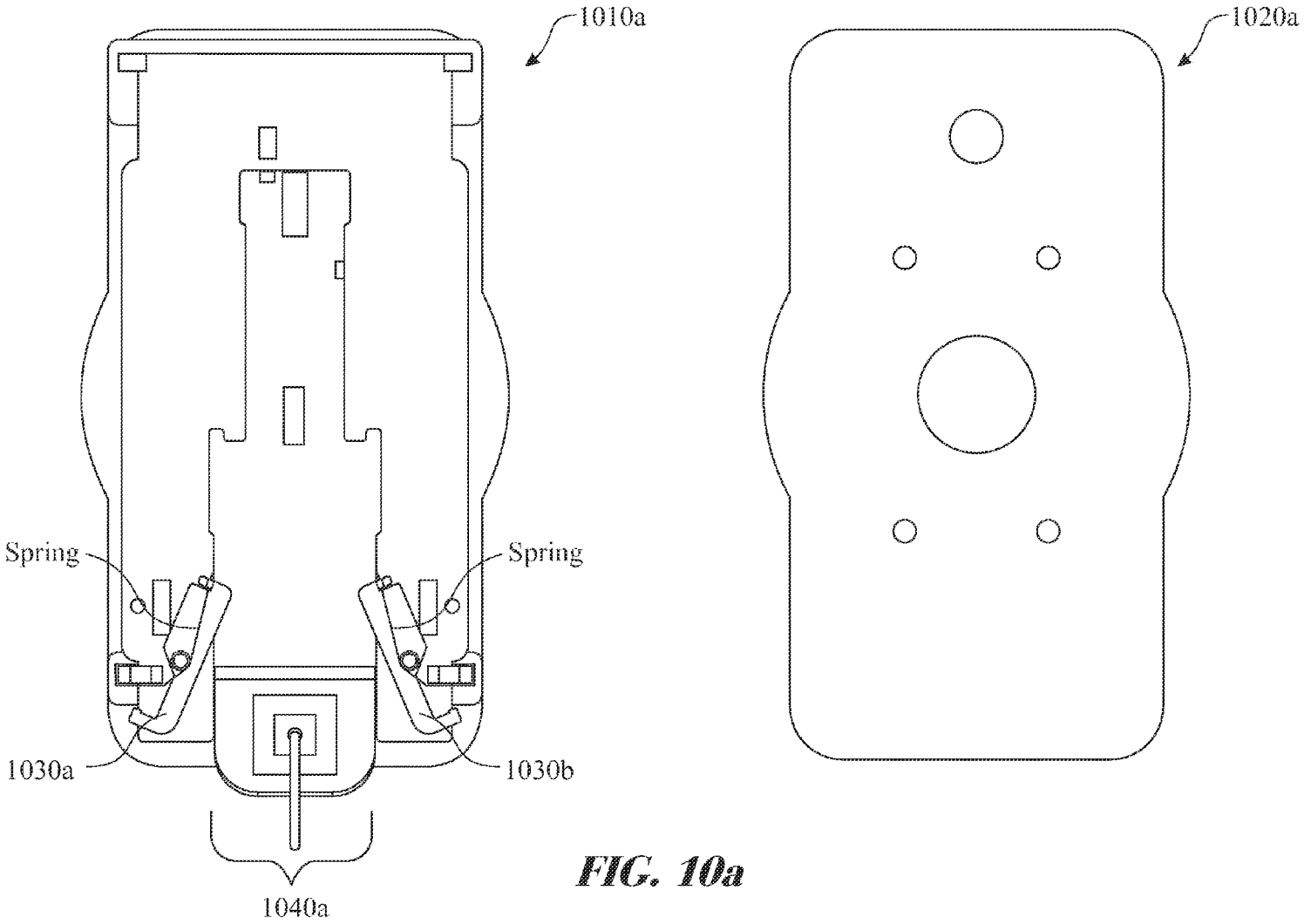
FIG. 10*a* presents an exemplary ink refilling station for refilling a printer ink cartridge.
Figure 10B:
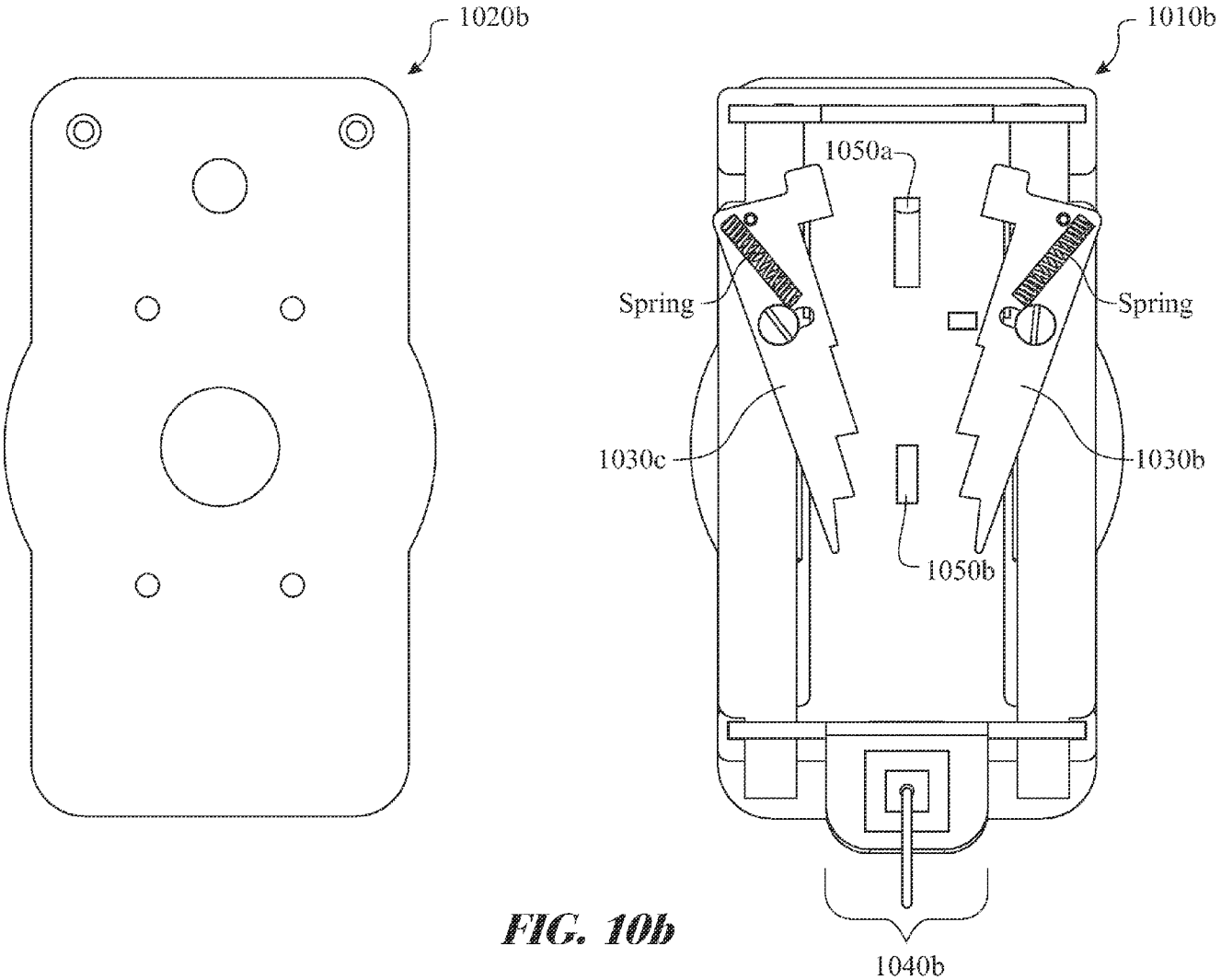
FIG. 10*b* presents an exemplary ink refilling station for refilling a printer ink cartridge.

FIGS. 10*a* and 10*b* illustrate ink refilling stations for refilling a printer ink cartridge in accordance with an exemplary embodiment of the present invention. As illustrated, an ink refilling station comprises an ink refilling clip 1010*a* and a mounting plate 1020*a*. In one embodiment, the mounting plate 1020*a* is mounted to a wall of the automated ink cartridge refilling system 700. Thereafter, the ink refilling clip 1010*a* may be coupled to the mounting plate 1010*a* accordingly. In the preferred embodiment, the ink refilling clip 1010*a* is coupled to the mounting plate 1010*a* using hydraulic pistons (not shown).

In operation, when the ink refilling clip 1010*a* is lifted in a diagonally upward position via the hydraulic pistons, the cartridge clamps 1030*a* and 1030*b* open in a diagonal direction as shown. The cartridge clamps 1030*a* and 1030*b* are coupled to the ink refilling clip 1010*a* using springs as shown. The ink cartridge can then be placed between the cartridge clamps 1030*a* and 1030*b*, which will close and secure the ink cartridge when the ink refilling clip 1010*a* is placed back in its original position. Moreover, the shape of the ink refilling clip 1010*a* may be designed to receive multiple types of ink cartridges having different shapes. As such, the ink refilling clip 1010*a* is configured to receive and refill multiple models of ink cartridges.

As further shown in FIG. 10*a*, the refilling clip 1010*a* comprises a silicon pad 1040*a*. The silicon pad 1040*a* is positioned such that when an ink cartridge is secured by the cartridge clamps 1030*a* and 1030*b*, the print head of the ink cartridge is aligned adjacent to the silicon pad 1040*a*. Using the silicon pad 1040*a*, old ink is removed and new ink is added using a similar operation as described above.

Another exemplary embodiment of an ink refilling station for refilling a printer ink cartridge is illustrated in FIG. 10*b*. The ink refilling station in FIG. 10*b* has substantially the same components as that described above with respect to FIG. 10*a*. In particular, this ink refilling station comprises an ink refilling clip 1010*b*, a mounting plate 1020*b*, cartridge clamps 1030*c* and 1030*d* and a silicon pad 1040*b*. One distinction between the two ink filling stations is the design of the respective cartridge clamps. In particular, different cartridge clamps are provided in each embodiment to receive differently shaped ink cartridges. The refilling clip 1010*b* may further comprise apertures 1050*a* and 1050*b*, which are spaces designed to receive abutments of certain models of ink cartridges. Employing two refilling stations with differently shaped cartridge clamps enables the refilling of a broader range of ink cartridges. It is further noted that when a user inputs a model number into the user interface 730 as discussed above, the LCD 710 will indicate to the user which refilling station should be used. This information can be stored in the database 725.

In a further embodiment, after the ink cartridge in either station is refilled, the refilling clip is rotated to an inverted position. Such inversion is performed when the refilled cartridge employs an ink bag rather than a foam sponge. By inverting the ink cartridge, entrapped air rises to the top of the ink bag, which is adjacent to the print head of the ink cartridge while in the inverted position. This air can then be removed using the suction operation as discussed above. If the ink cartridge were not inverted, then the suction function would merely remove ink.

Figure 11:
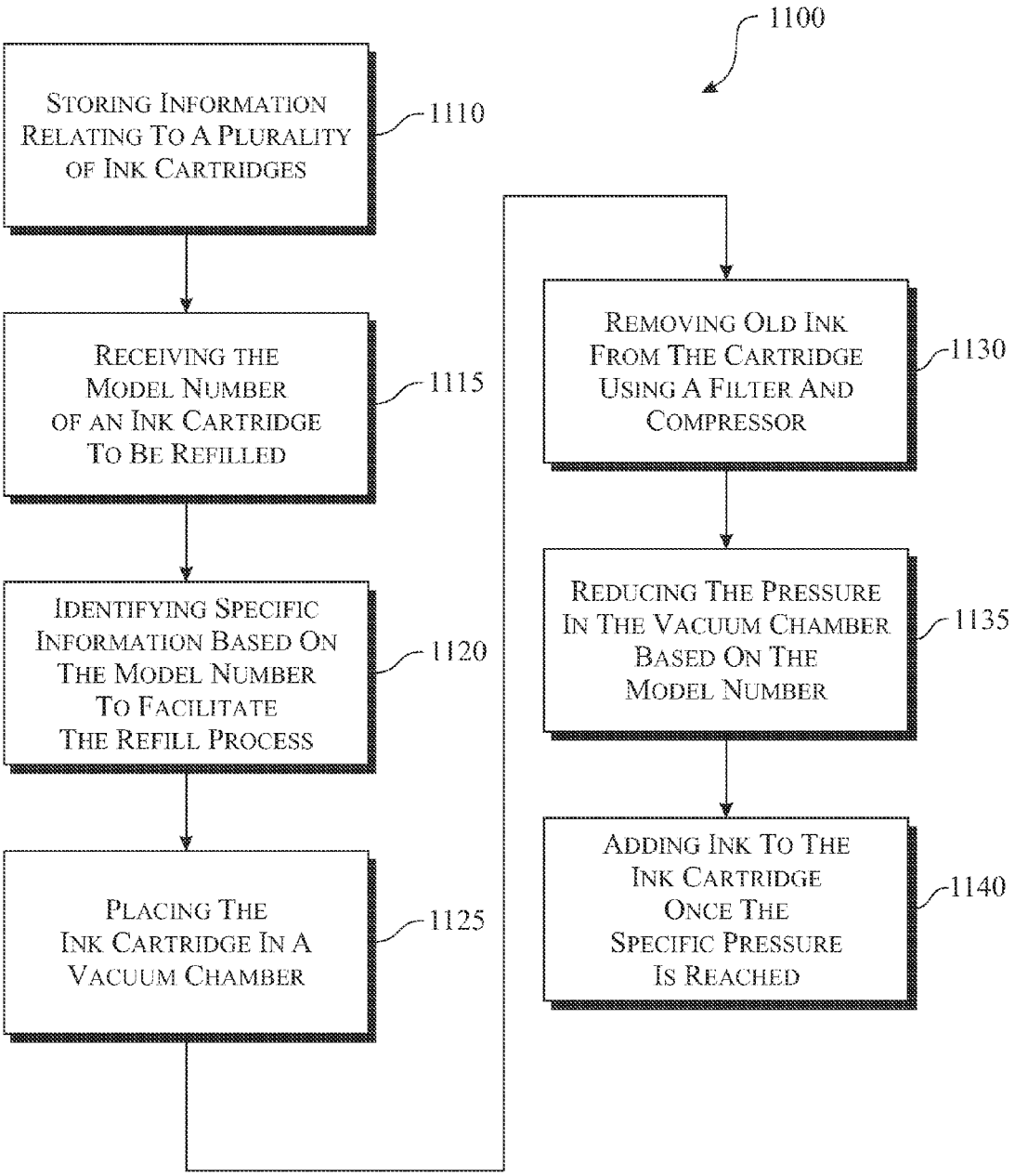
FIG. 11 presents another exemplary method for refilling a printer ink cartridge.

Another exemplary refilling a printer ink cartridge method 1100 is presented in FIG. 11. It should be understood that the method can be performed employing the automated ink refilling system 700 described above.

Initially, at step 1110, information relating to a plurality of the ink cartridges is stored in a database, such as database 725. Once a user determines the model number of the ink cartridge to be refilled, this information is input at step 1115. Once the model number is received, certain information can be identified from database 725, such as the amount of ink required to refill the ink cartridge, the particular cartridge cradle to be used during the refill process, and the specific pressure for the vacuum chamber based on the model number (step 1120). If the cartridge cradle is employed, apertures in the lid of the cartridge cradle guide the insertion of the needle, which are provided to add ink.

Next, at step 1125, the ink cartridge is placed in a vacuum chamber, such as vacuum chamber 740 described above. In one embodiment, the ink cartridge is secured in cartridge cradle 800, which is in turn placed in docking station 780 of vacuum chamber 740. Once the ink cartridge is placed in the vacuum chamber, old ink is removed from the ink cartridge by a filter and compressor (step 1130).

Once all the old ink is removed, the pressure in the vacuum chamber is reduced at step 1135 to the specific pressure prescribed by the model number. Finally, at step 1140, once the specific pressure in the vacuum chamber is reached, the required amount of ink is added. Additional steps of the method not shown in FIG. 11, but which can be performed at any stage of the refill process include ultrasonically cleaning a print head of the ink cartridge at 28 kilohertz or less and heating the ultrasonic cleanser to a temperature between 60° and 80° Celsius.

Figure 12:
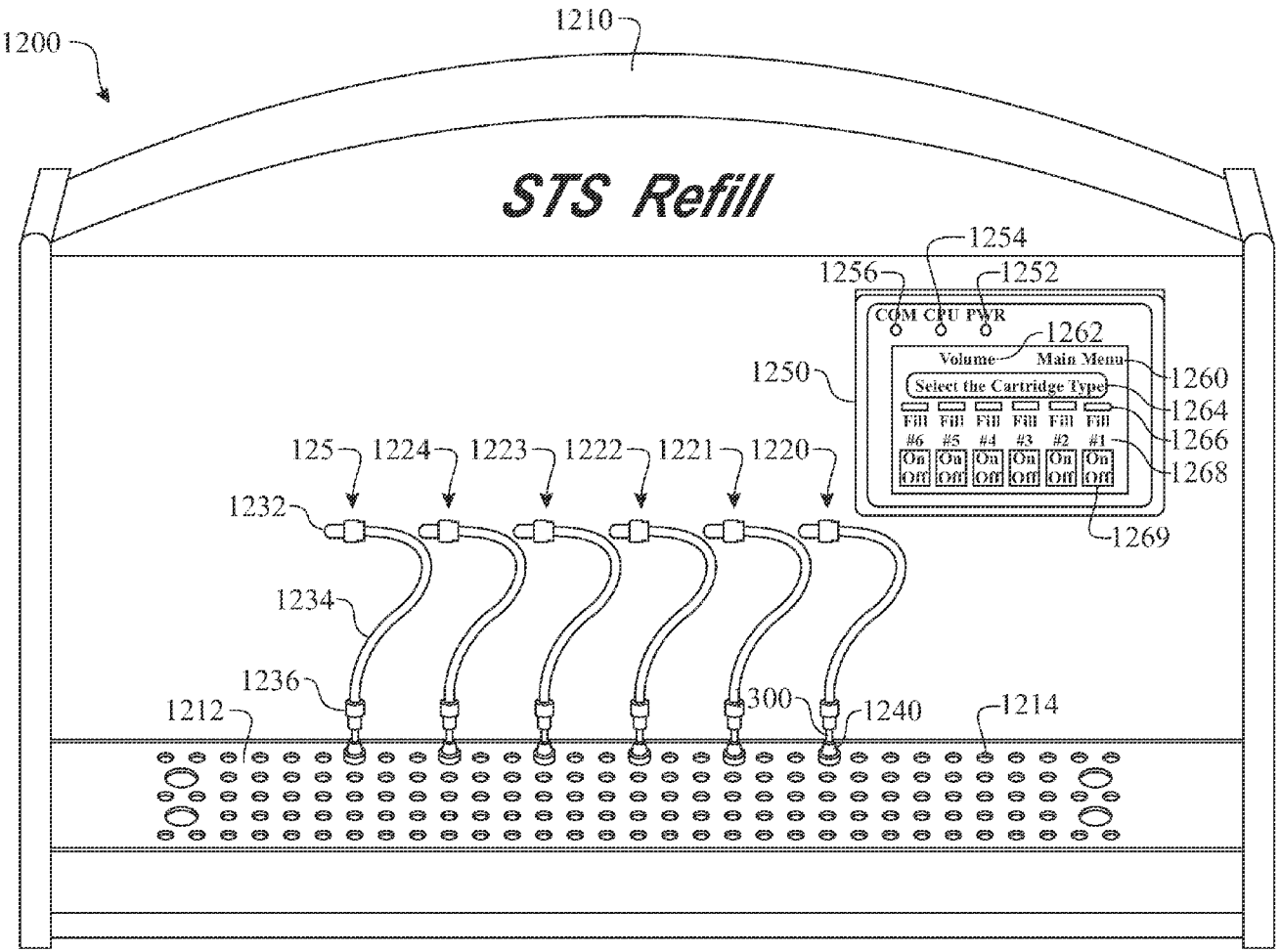
FIG. 12 presents a front elevation view of an exemplary wide format ink cartridge refilling station.

The present invention comprises a wide format cartridge refill station 1200 and respective method for refilling a wide format printer ink cartridge. An exemplary wide format cartridge refill station 1200 is illustrated in FIG. 12. In a preferred embodiment, the method and system for refilling the wide format printer ink cartridge utilizes a specific ink insertion needle. The system preferably comprises a positive displacement, peristaltic ink-filling pump that operates under computer control to ensure that the desired amount of ink is added to the cartridge. The desired amount includes a predetermined overfill volume, the overfill volume preferably being approximately 10% overage. As described below, an ink filling and pause cycle can be utilized during the ink injection step.

The wide format cartridge refill station 1200 is preferably operated via a computer and respective software. The software (program code) elements of the present invention may be implemented with any programming or scripting language such as C, C++, C#, Java, COBOL, assembler, PERL, Unix, Linux, PLC, HMI, or the like, with the various algorithms being implemented with any combination of data structures, objects, processes, routines or other programming elements. The system preferably incorporates software modules preferably programmed in Visual C and Visual Basic. Any computer having an operating system using Microsoft Windows 95 or newer can execute the object code created.

Further, it should be noted that the present invention may employ any number of conventional techniques for data transmission, signaling, data processing, network control, and the like.

It should be appreciated that the particular implementations shown and described herein are illustrative of the invention and its best mode and are not intended to otherwise limit the scope of the present invention in any way. Indeed, for the sake of brevity, conventional data networking, and application development and other functional aspects of the systems (and components of the individual operating components of the systems) may not be described in detail herein. It should be noted that many alternative or additional functional relationships or physical or virtual connections might be present in a practical electronic data communications system.

As will be appreciated by one of ordinary skill in the art, the present invention may be embodied as a method, a data processing system, a device for data processing, and/or a computer program product. Accordingly, the present invention may take the form of an entirely software embodiment, an entirely hardware embodiment, or an embodiment combining aspects of both software and hardware. Furthermore, the present invention may take the form of a computer program product on a computer-readable storage medium having computer-readable program code means embodied in the storage medium. Any suitable computer-readable storage medium may be utilized, including hard disks, CD-ROM, optical storage devices, magnetic storage devices, and/or the like.

The present invention is described below with reference to flowchart illustrations of methods, apparatus (e.g., systems), and computer program products according to various aspects of the invention. It will be understood that each flowchart illustrations, and combinations of flowchart illustrations, respectively, can be implemented by computer program instructions. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, flowchart illustrations support combinations of means for performing the specified functions, combinations of steps for performing the specified functions, and program instruction means for performing the specified functions. It will also be understood that each functional block of the flowchart illustrations, and combinations of functional blocks in the flowchart illustrations, can be implemented by either special purpose hardware based computer systems that perform the specified functions or steps, or suitable combinations of special purpose hardware and computer instructions.

One skilled in the art will also appreciate that, for security reasons, any databases, systems, or components of the present invention may consist of any combination of databases or components at a single location or at multiple locations, wherein each database or system includes any of various suitable security features, such as firewalls, access codes, encryption, de-encryption, compression, decompression, and/or the like.

The scope of the invention should be determined by the appended claims and their legal equivalents, rather than by the examples given herein. For example, the steps recited in any method claims may be executed in any order and are not limited to the order presented in the claims. Moreover, no element is essential to the practice of the invention unless specifically described herein as "critical" or "essential."

The wide format cartridge refill station 1200, as illustrated in FIG. 12 comprises a refill station housing 1210. A refill station work tray 1212 is provided along a lower, working region of the refill station housing 1210. The refill station work tray 1212 is positioned above a fluid overflow trench. A series of work tray aperture 1214 are provided through the refill station work tray 1212, allowing any ink to pass through into the fluid overflow trench. The wide format cartridge refill station 1200 comprises a series of refill stations. The exemplary embodiment identifies the refill stations as follows:

| Ref. No. | Description |
|---|---|
| 121 | First individual refill station |
| 122 | Second individual refill station |
| 123 | Third individual refill station |
| 124 | Fourth individual refill station |
| 125 | Fifth individual refill station |
| 126 | nth individual refill station |

Figure 13:
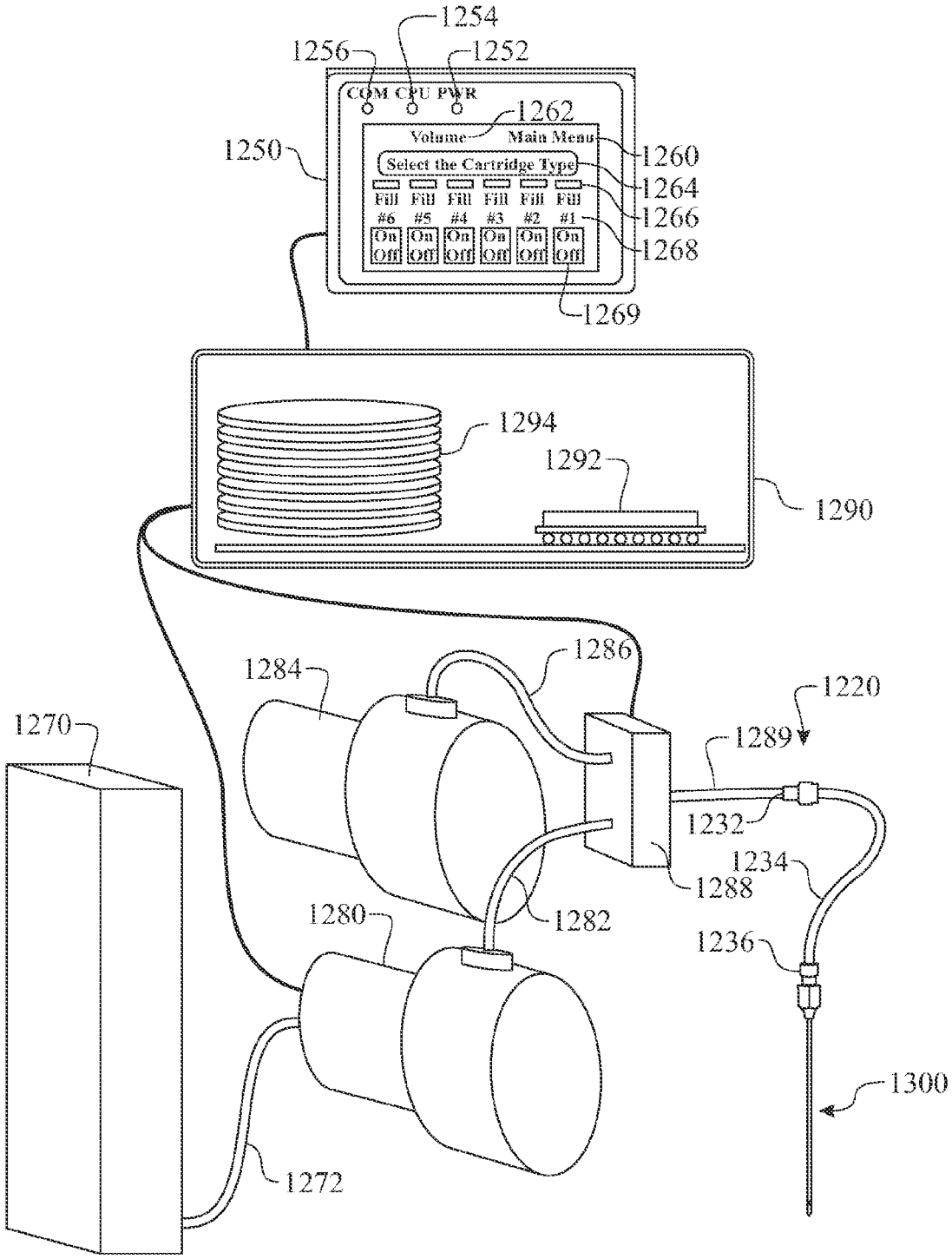
FIG. 13 presents a block diagram of an exemplary ink refill station.

Each station 1220, 1221, 1222, 1223, 1224, 1225 includes an ink reservoir 1270, an ink source conduit 1272, an ink pump 1280, an ink station source conduit 1282 (continuing via a valve to fill station conduit 1289), a rotational ink tube connector 1232, an ink fill tube 1234, a fill tube needle connector 1236, and an ink fill needle 1300 as illustrated in FIGS. 12 and 13. It is desirable to configure each station as its own system, comprising its own ink reservoir 1270, ink pump 1280, needle 1300, and conduits 1272, 1282, 1289 to avoid any cross contamination.

An ink extraction system can be integrated into the system, incorporating an ink extraction pump 1284 for removing any residual ink from the cartridge. The ink extraction pump 1284 is in fluid communication with the rotational ink tube connector 1232 via an ink station extraction conduit 1286. A flow direction control valve 1288 provides selectable flow control between a fill process and an extraction process. The flow direction control valve 1288 directs flow from either the ink station source conduit 1282 or the ink station extraction conduit 1286 into the valve to fill station conduit 1289. It is understood that the ink pump 1280 and the ink extraction pump 1284 can be the same unit; wherein the function is directed by the controller 1250. The controller can fill the cartridge with a standard operation, transferring ink from the ink reservoir 1270 or the controller can reverse the pump and direct the extracted ink to a discharge container.

The ink pump 1280 pulls ink from the source ink reservoir 1270 via the ink source conduit 1272, transferring the ink to the rotational ink tube connector 1232 via the ink station source conduit 1282, through the flow direction control valve 1288 and continuing through the valve to fill station conduit 1289. An ink fill tube 1234 provides fluid communication between the rotational ink tube connector 1232 and the ink fill needle 1300. The ink fill needle 1300 (detailed in FIGS. 14 and 15) is removably coupled to the ink fill tube 1234 by coupling a source connector 1308 of the ink fill needle 1300 to the fill tube needle connector 1236. The rotational ink tube connector 1232 is preferably a pivotal fixture, allowing maximum freedom of motion to the ink fill tube 1234. The stations 1221-1226 are controlled via a station controller 1250. The volume of ink transferred into the cartridge can be monitored by the known volume transfer rate of the pump 1280 and time of operation of the pump 1280, or by the inclusion of a meter (not shown, but well understood). A volume or flow rate meter can be integrated along the ink source conduit 1272, the ink station source conduit 1282 or both.

The ink extraction pump 1284 can be utilized to extract any residual ink or excess ink from the cartridge. The ink extraction pump 1284 is in fluid communication with the cartridge through the ink station extraction conduit 1286. The ink station extraction conduit 1286 is in fluid communication with the valve to fill station conduit 1289 via an operable control of the flow direction control valve 1288. The computer 1290 would direct the flow direction control valve 1288 to provide fluid communication between the ink station extraction conduit 1286 and the valve to fill station conduit 1289. The ink extraction pump 1284 would then begin extracting the desired volume of fluid in accordance with the programmed instructions for ink fill operation software. The extracted ink is collected in a spent ink container (not shown, but well understood). It is understood the can utilize a single ink extraction pump 1284, which is connected to a plurality of fill stations, as any residual ink remaining within the ink station extraction conduit 1286 will not impact the fill process.

The station controller 1250 includes a computer 1290 comprising a microprocessor 1292 and a data storage media 1294, a user interface such as a touch screen, operational software, and a cartridge fill database. The software and database can be stored within the data storage media 1294. The database maintains a plurality of records associated with a type of printer and the print cartridge used in that printer. Moreover, a user is able to input cartridge identifying information to facilitate the refill process using computer ink cartridge refilling system. In a further embodiment of the present invention, the cartridge identifying information can be the model number of the ink cartridge to be refilled. Alternatively, the user can manually enter the cartridge type and ink volume.

The exemplary station controller 1250 utilizes a touch screen display as a user interface. The station controller 1250 can include a series of indicator LED's, such as a power indicator 1252, a processor indicator 1254, and a communications indicator 1256. The user can contact a main menu button 1260 and scroll to an operational control menu (illustrated). The user selects a cartridge selection button 1264 to enter the specific cartridge being refilled. The volume is presented to the user via a cartridge volume indicator 1262. The operator selects the ink color by selecting the respective fill station referenced by a station reference 1268. The operator positions the respective ink fill needle 1300 into the cartridge and selects a respective activation button 1269. The controller then completes the ink refilling processes in accordance with the preprogrammed data respective to the selected ink cartridge. A fill status indicator 1266 can convey the fill status to the operator. The data can include the overfill volume of ink, the desired target volume of ink, the color, any specific cartridge filling steps, and the like. The specific cartridge filling steps can include directions for a series of fill/pause steps as desired.

Some additional features include the use of color-coded pumps 1280, color-coded conduits 1272, 1282, 1234, and color coded ink reservoirs 1270 to aid in referencing the ink colors. It is desirable to utilize a quick disconnect interface between the source ink reservoir 1270 and the ink source conduit 1272. It is desirable to include a colorless ink cartridge 1270 for use in cleaning pre-used ink cartridges.

A series of needle receiving element 1240 can be inserted through any of the work tray aperture 114 for receiving an ink fill needle 1300. Any dripped ink is collected in the fluid collection basin. This maintains a clean working environment for the wide format cartridge refill station 1200.

Figure 14:
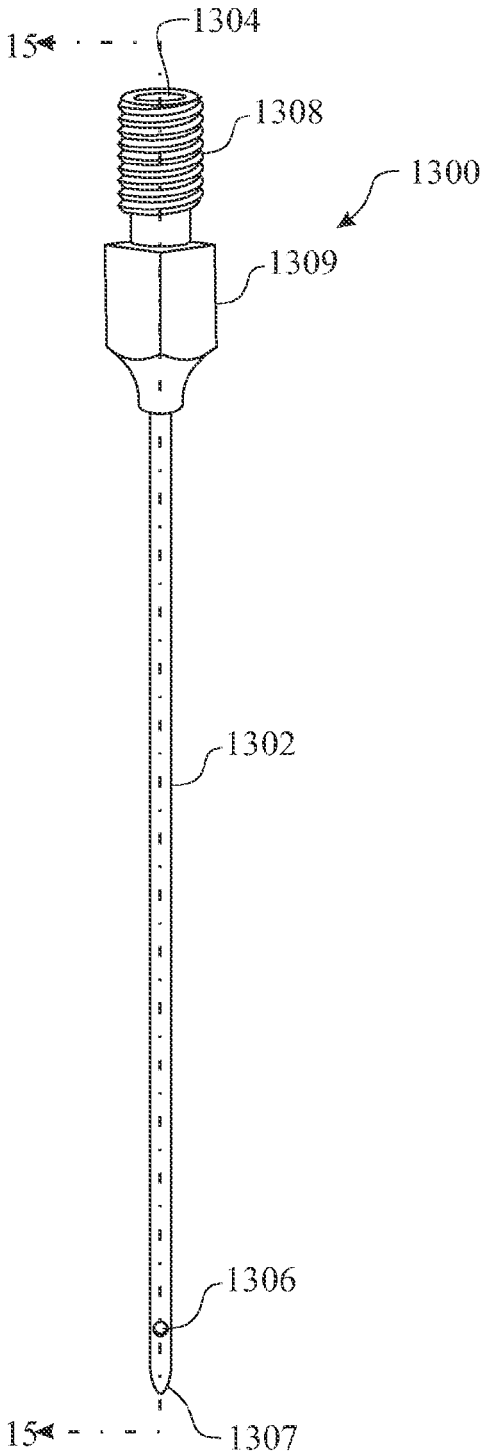
FIG. 14 presents an side elevation view of an exemplary wide cartridge fill needle.
Figure 15:
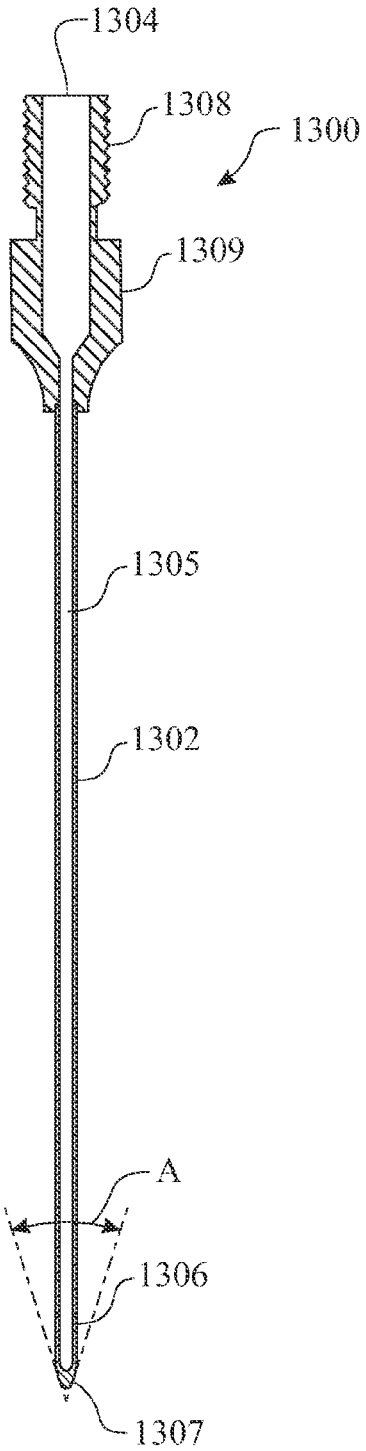
FIG. 15 presents a cross-sectional view of the wide cartridge fill needle of FIG. 13 taken along section line 15-15.

The wide format ink cartridges generally comprise a rubber or nylon ink seal providing a sealing passageway for the ink to transfer into and from a soft-sided ink reservoir. It was recognized that the current processes were not conducive to filling the wide format ink cartridges. An ink fill needle 1300, as illustrated in FIGS. 14 and 15, was developed to specifically respond to the unique format of the wide format ink cartridges. The ink fill needle 1300 is formed having a tubular needle conduit 1302 extending from a source connector 1308. A needle passage 1305 is provided within the needle conduit 1302, having a needle passage entrance 1304 proximate a supply end and being sealed at a needle tip 1307. At least one needle discharge aperture 1306 is provided along a sidewall of the needle conduit 1302 proximate a transition point between the sidewall and the needle tip 1307. The ink fill needle 1300 can include a single needle discharge aperture 1306, a pair of needle discharge apertures 1306 positioned at 1280 degrees from each other, three needle discharge apertures 1306 positioned at 120 degrees from each other, and the like. A connector grip 1309 can be integrated into the ink fill needle 1300 proximate the source connector 1308, wherein the connector grip 1309 provides the user with a region for engaging a tool to aid in securing the source connector 1308 with the fill tube needle connector 1236. The ink fill needle 1300 is preferably shaped in a linear form factor.

The ink fill needle 1300 can be described as an extraction needle, wherein the same design is utilized for two separate functions. The needle conduit 1302 can provide a conduit for filling ink or extracting ink from the cartridge and referred to as a fill conduit or an extraction conduit. The needle discharge aperture 1306 can be used for discharging ink or referred to as an extraction aperture for removal of ink. The needle passage entrance 1304 can be referred to as a vacuum end of the ink fill needle 1300.

Two key factors in the needle design contribute to perfecting the refilling process of the wide format cartridges. The needle discharge aperture 1306 is a blunt design having an angle referenced as "A" of approximately 35 degrees. The needle discharge apertures 1306 are positioned through the sidewall discharging the ink in a direction that is perpendicular to the needle conduit 1302. The blunt design of the needle discharge aperture 1306 ensures against damaging or puncturing a soft-sided ink reservoir of the wide format cartridge. Positioning the needle discharge aperture 1306 avoids any removal of material from the port seal 1406 (FIG. 5), which is critical to ensure the seal avoids any leaks.

Figure 16:
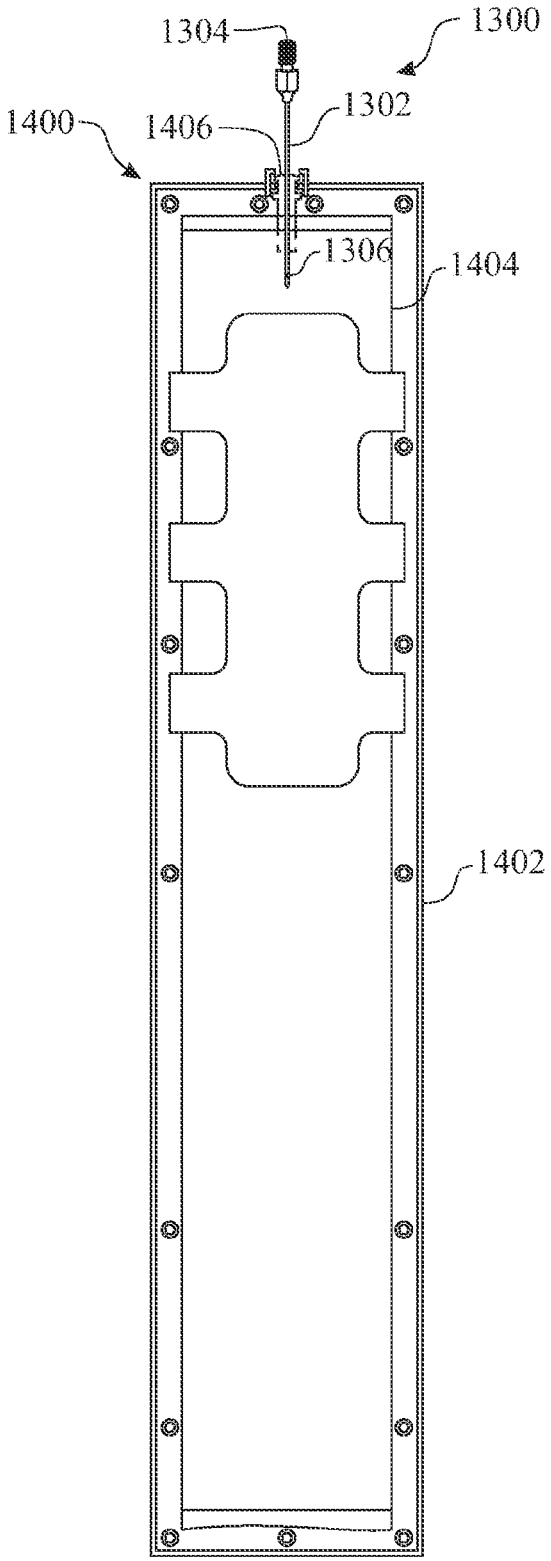
FIG. 16 presents a cross-sectional view illustrating an interior and respective operative components of a single port wide format ink cartridge incorporating a fill needle inserted therein.
Figure 17:
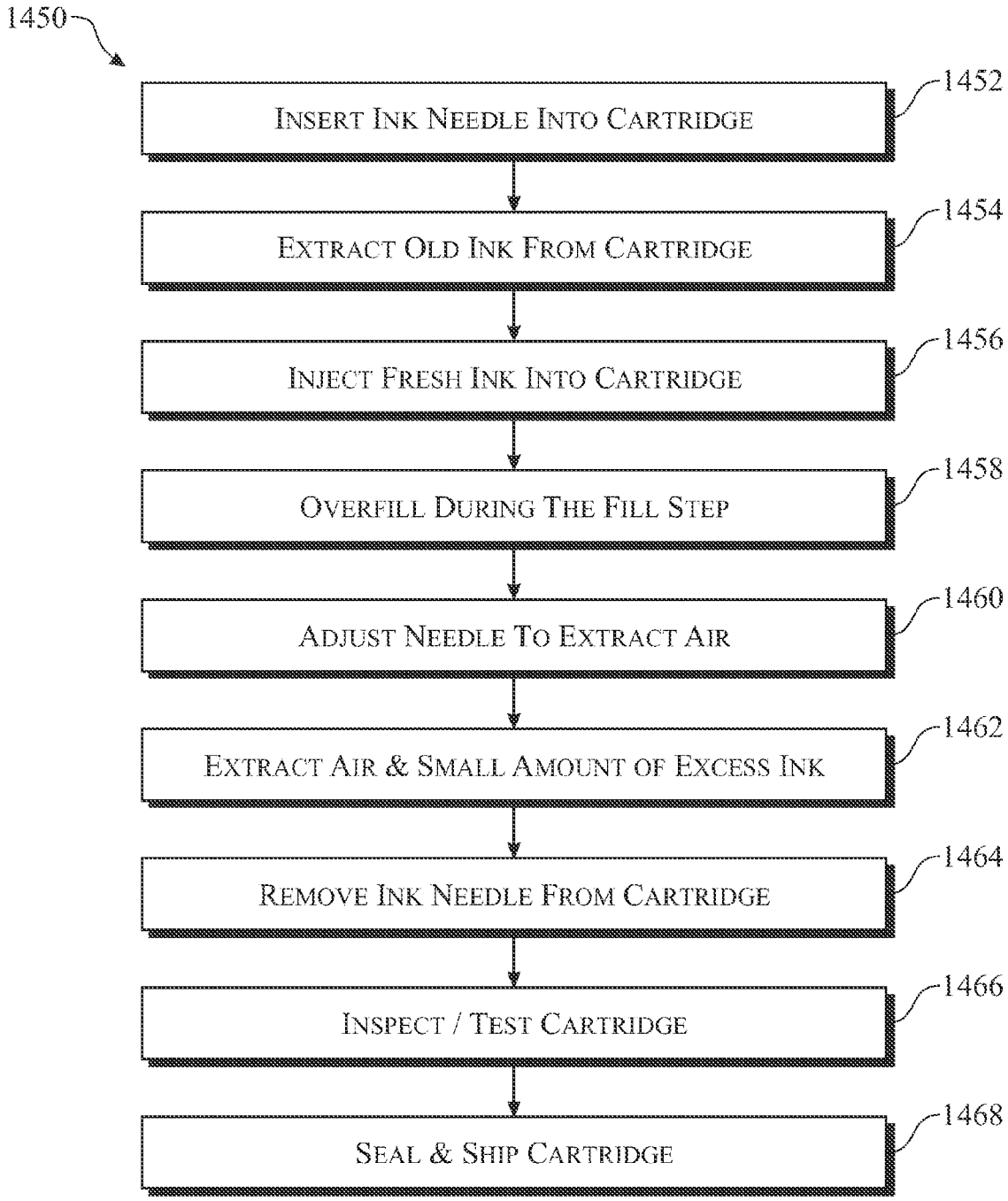
FIG. 17 presents an exemplary flow diagram detailing a method for filling a single port wide format ink cartridge.
Figure 18:
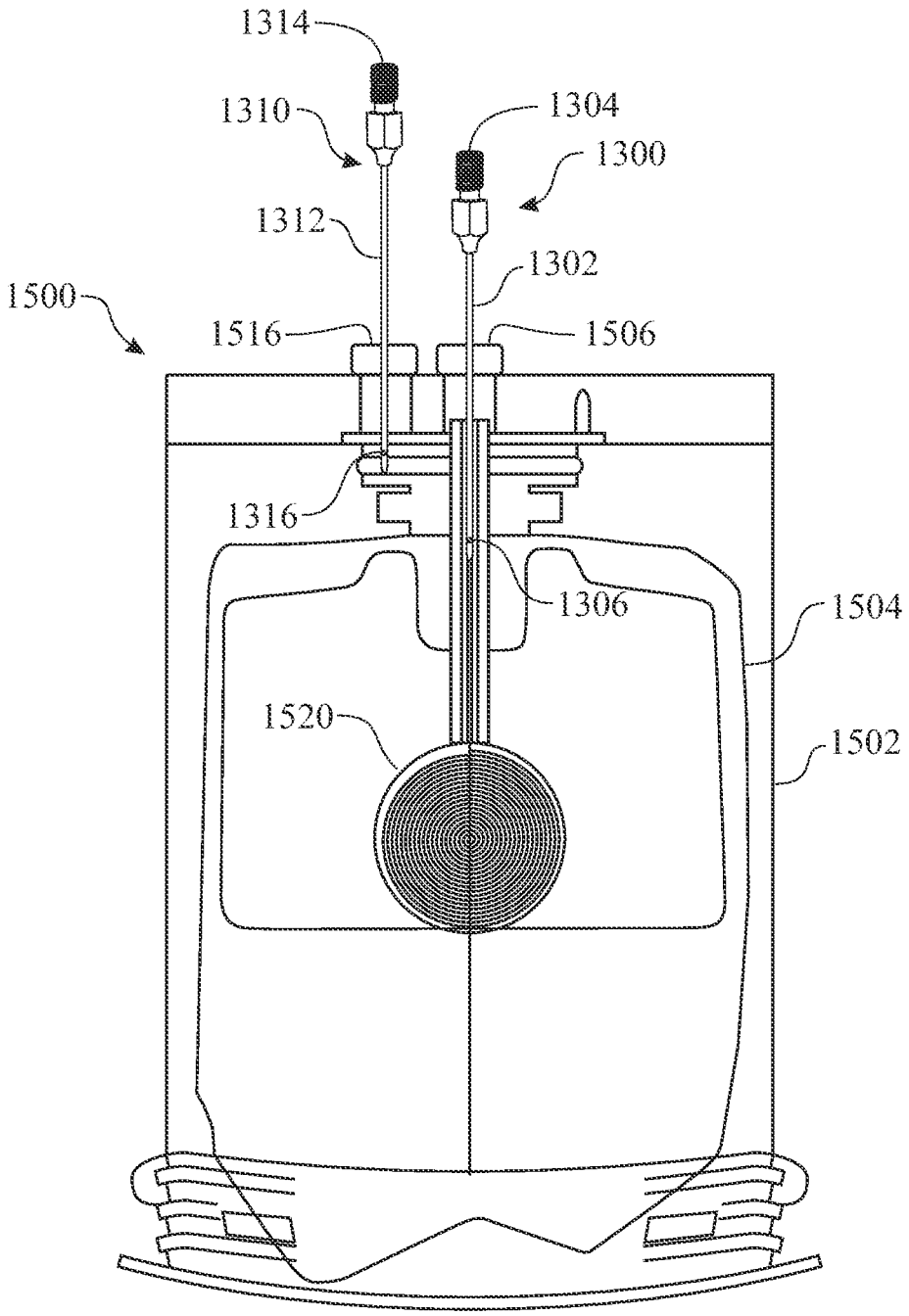
FIG. 18 presents a cross-sectional view illustrating an interior and respective operative components of a dual port wide format ink cartridge incorporating a fill needle and a vent needle inserted therein.

The wide format cartridges are sold in several form factors. The disclosure details a single port wide format cartridge 1400, as illustrated in FIG. 16 and a dual port wide format cartridge 1500, as illustrated in FIG. 18. The single port wide format cartridge 1400 is filled in accordance with a fill process detailed in the single port ink refill flow process 1450 presented in FIG. 17. The single port wide format cartridge 1400 includes an ink reservoir 1404 positioned within a wide format enclosure 1402. An ink port seal 1406 is a self-sealing port providing fluid communication between the ink reservoir 1404 and a printer ink system (not shown, but well understood by application). The operator inserts the ink fill needle 1300 into the single port wide format cartridge 1400 through the ink port seal 1406 in accordance with an ink needle insertion step 1452. A vacuum is applied to the ink fill station to extract any residual ink from the spent cartridge 1400, as referred to as a residual ink extraction step 1454. The operator then initiates a fill step 1456, injecting fresh ink into the single port wide format cartridge 1400. The computer 1290 operates the ink fill pump 1280 monitoring the volume of ink transferred to the single port wide format cartridge 1400. The computer 1290 overfills the ink reservoir 1404 in accordance with an overfill step 1456. The ink reservoir 1404 is generally overfilled by 5 to 10%. It is understood the overfilling can actually be set anywhere from 1% on up. Once filled, the operator can optionally adjust the needle position 1460 to extract any trapped air within the ink reservoir 1404. The system converts to a vacuum and removes any entrapped air and a portion of the excess ink, in accordance with an entrapped air and excess ink extraction step 1462. Alternately, the system can utilize the excess pressure provided within the ink reservoir 1404 to "burp" the air and excess ink by opening a vent valve placed in line. The vent valve can be integrated into the flow direction control valve 1288. The flow direction control valve 1288 can be a solenoid valve. The system automatically stops following removal of a small volume of ink, leaving the cartridge with a volume of ink, and very minimal (if any) entrapped air. The operator then removes the ink fill needle 1300 from the ink port seal 1406 per an ink needle removal step 1464. The single port wide format cartridge 1400 is inspected and tested 1466 by inserting the refilled single port wide format cartridge 1400 into a test station to ensure the refilled single port wide format cartridge 1400 meets the minimum quality standards. If the refilled single port wide format cartridge 1400 passes the inspection and testing, the single port wide format cartridge 1400 is subjected to a sealing, packaging, and shipping step 1468.

Figure 19:
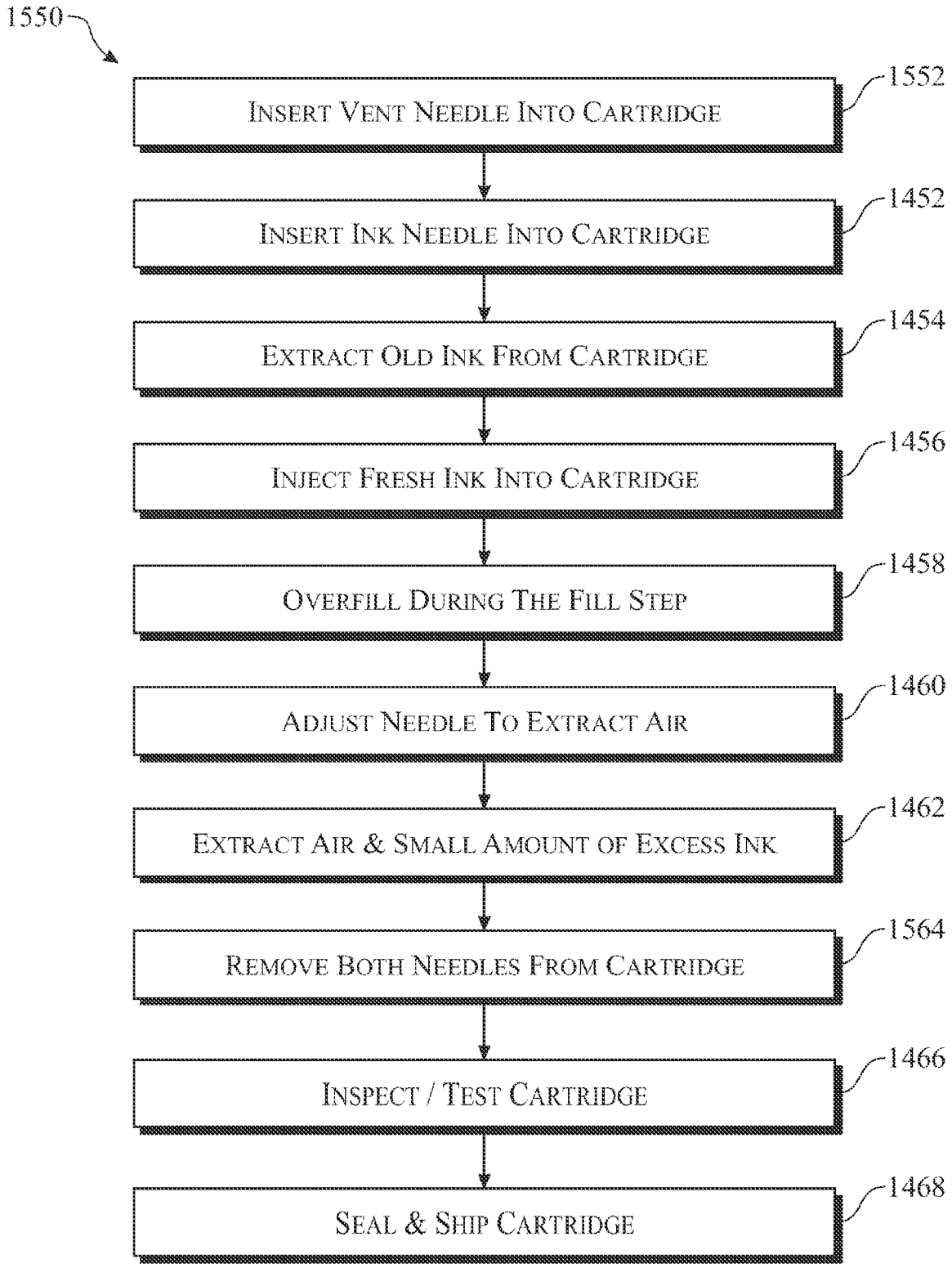
FIG. 19 presents an exemplary flow diagram detailing a method for filling a dual port wide format ink cartridge.

A dual port wide format cartridge 1500 comprises a more complex fill system, as illustrated in FIG. 18. The dual port wide format cartridge 1500 is filled in accordance with a fill process detailed in the dual port ink refill flow process 1550 presented in FIG. 19. The dual port wide format cartridge 1500 includes an ink reservoir 1504 positioned within a wide format enclosure 1502. An ink port seal 1506 is a self-sealing port providing fluid communication between the ink reservoir 1504 and a printer ink system (not shown, but well understood by application). A vent port seal 1516 is integrated into the dual port wide format cartridge 1500, the vent port seal 1516 providing an airflow passage between the ink reservoir 1504 and atmosphere. An optional volume indicator 1520 can be integrated into either wide format cartridge 1400, 1500. The operator inserts a vent needle 1310, wherein the vent needle 1310 is similar to an ink fill needle 1300 used for venting, into the dual port wide format cartridge 1500 through the vent port seal 1516 in accordance with a vent needle insertion step 1552. The vent needle 1310 comprises a needle conduit 1312 providing fluid communication between a needle vent aperture 1316 and a needle vent exit 1314. The operator inserts the ink fill needle 1300 into the dual port wide format cartridge 1500 through the ink port seal 1506 in accordance with an ink needle insertion step 1452. The dual port ink refill flow process 1550 continues in accordance with steps referenced as 1454 through 1468 as previously described in the single port ink refill flow process 1450. The needle removal step 464 directs the operator to remove both the ink fill needle 1300 and vent needle 1310 from the respective ports.

Figure 20:
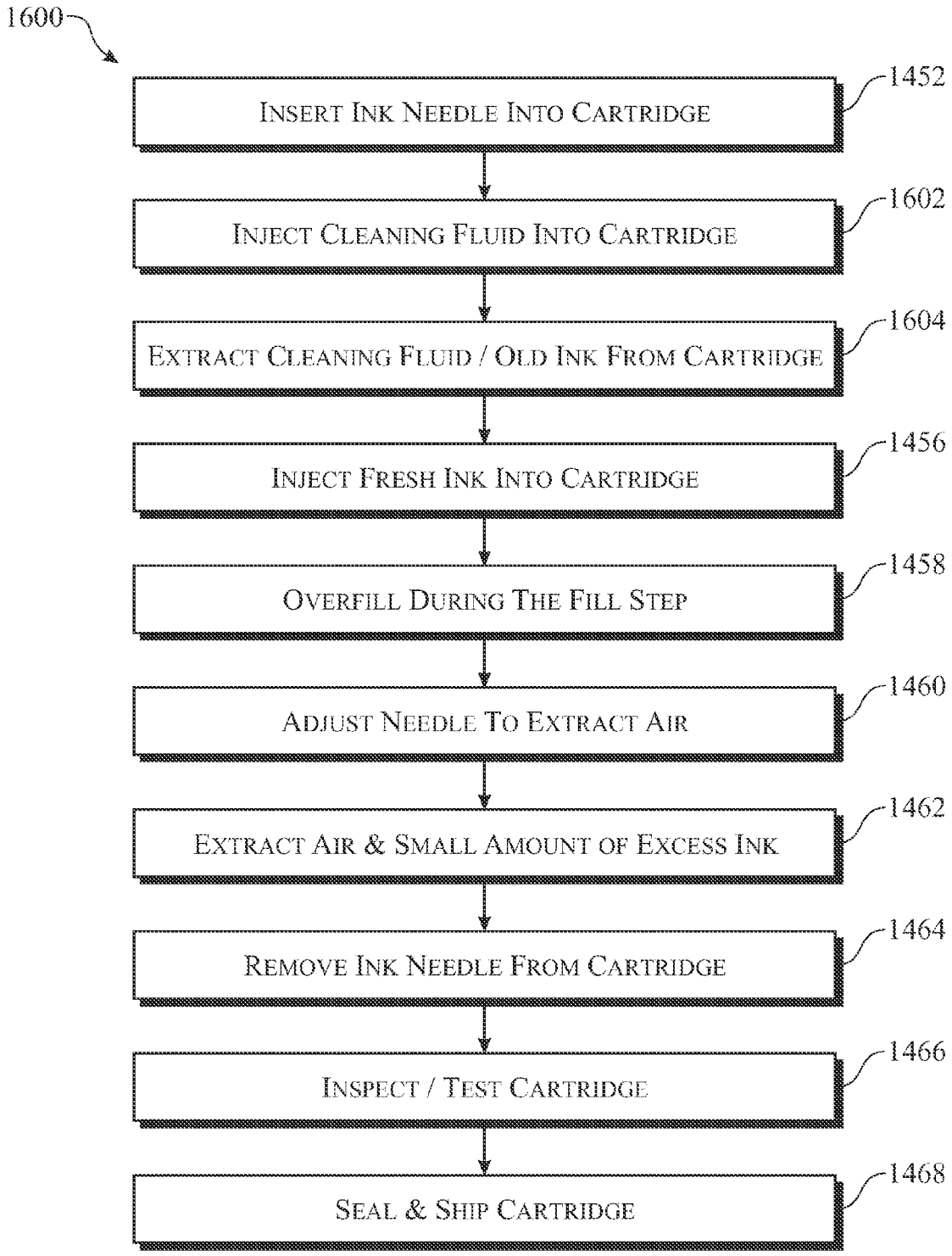
FIG. 20 presents an exemplary flow diagram detailing a method for cleaning and filling a wide format ink cartridge.

At times, an operator may desire to change the ink color or quality from the original color or quality to a new color or quality. This can be accomplished by adding a series of reservoir cleaning steps to the single port ink refill flow process 1450, as illustrated in a refill and pre-cleaning process 1600 of FIG. 20. The system injects a cleaning fluid into the cartridge 1400, 1500, in accordance with a cleaning fluid injection step 1602. The cleaning fluid is generally a colorless ink mixture, having the same general chemistry as the refilling ink. The operator can optionally shake the filled cartridge, subject to a vibrator source, and the like to aid in mixing any residual ink with the cleaning fluid. The system advances by extracting the cleaning fluid and any residual ink from the cartridge 1400, 1500, in accordance with a cleaning fluid extraction step 1604. The refill and pre-cleaning process 1600 continues in accordance with steps referenced as 1454 through 1468 as previously described in the single port ink refill flow process 1450. It is understood the same cleaning steps 1602, 1604 can also be included in the dual port ink refill flow process 1550.

In accordance with the foregoing description, the present invention provides the following advantages:

The design of the needle tip 1307 ensures the ink reservoir 1404, 1504 does not get damaged. The needle tip 1307 does not damage the port seals of the wide format cartridges 1400, 1500. The location of the needle discharge apertures 1306 provides several advantages. The ink discharges laterally, aiding in the fill process while eliminating any potential generation of air bubbles. The ink contacts the sidewalls of the ink reservoir 1404, 1504 and uses surface tension to continue to the balance of the ink. Contrarily, if the ink where discharged towards the volume of ink, the discharged ink would create bubbles when it contacts the volume of the ink. This can be compared to rain falling onto a body of water. The splashing introduces air into the body of water.

By using a positive displacement pump 1280, computer 1290 can precisely control the amount of ink that is added to the cartridge to perfect the proper refilling process. The ink fill pump 1280 overfills the expandable soft-sided ink reservoirs 1404, 1504, displacing any entrapped air. The remaining entrapped air and a portion of the excess ink is removed via an extraction step 1462 following the overfilling step 1458.

It is understood the process can be applied to cartridges comprising semi-rigid sided reservoirs as well as those comprising soft-sided reservoirs 1404, 1504.

The quality of ink directly impacts the quality and efficiency of the printing process. Contaminants, such as particles and gas impact the quality and efficiency of the printing process. The contaminants can impair passage through the print head and more specifically through the ink reservoir, the outlet damper (funnel entry to the nozzle), and more importantly at the print head nozzle. The prior art solutions were directed towards processing ink with precautionary steps to minimize introduction of contaminants into the process.

Several exemplary solutions are introduced in the various embodiments presented in FIGS. 21 through 26. The exemplary solutions introduce at least one particle filtration element 1740, 1840, 1842, 1844 prior to each ink pump 1750, 1850 and at least one degassing filtration element 1760, 1860, 1862 subsequent to each ink pump 1750, 1850. Each of the at least one particle filtration elements 1740, 1840, 1842, 1844 mechanically removes suspended particulate matter from the fluid of each respective ink composition. Similarly, each of the at least one degassing filtration elements 1740, 1840, 1842, 1844 mechanically removes entrapped air or other gasses from the ink composition of each respective ink composition.

Figure 21:
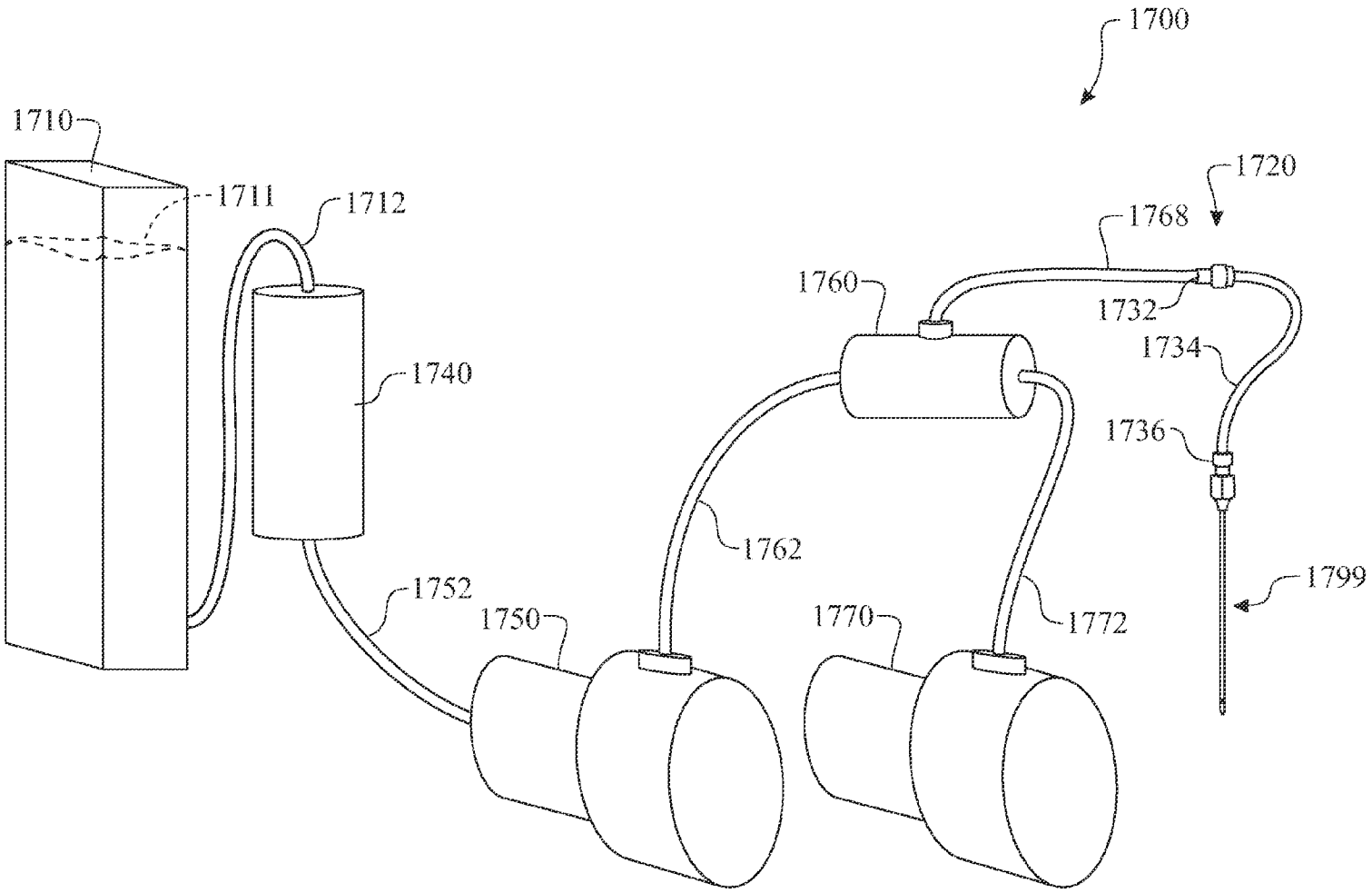
FIG. 21 presents a schematic diagram of an exemplary single stage particle filtration and single stage degassing ink preparation process.

An exemplary ink cartridge pre-fill processing 1700 is illustrated by a schematic diagram in FIG. 21. Ink composition 1711 is stored in one or more source ink reservoirs 1710. The ink cartridge pre-fill processing 1700 provides the necessary elements, in fluid communication with one another, to transfer and process ink composition 1711 from the one or more source ink reservoirs 1710 to an ink dispensing station 1720. To avoid color contamination, it is preferred that a refilling station would comprise one ink cartridge pre-fill processing 1700 for each desired specific ink color, such as cyan, magenta, yellow, and black.

The ink cartridge pre-fill processing 1700 illustrates an exemplary process for removing suspended particles from the ink composition 1711 using the particle filter element 1740 and an exemplary process for removing entrapped air or other gas from the ink composition using the degassing element 1760. The ink composition 1711 is drawn from the source ink reservoir 1710 by an ink fill pump 1750. The particle filter element 1740 is integrated into the ink cartridge pre-fill processing 1700 between the source ink reservoir 1710 and ink fill pump 1750. A pre filter ink source conduit 1712 provides fluid communication between the source ink reservoir 1710 and the particle filter element 1740. A post filter ink source conduit 1752 provides fluid communication between the particle filter element 1740 and the ink fill pump 1750. The particle filter element 1740 removes particulate matter from the ink composition 1711. Details of the particle filter element 1740 will be described using an exemplary particle filter element 1900 presented in FIG. 23. The size of the particulate matter being filtered out from the ink composition 1711 is based upon the mesh size of the filter material, as will be described later herein. The ink composition 1711 continues towards the ink fill needle 1799, passing through the degassing element 1760. The ink composition 1711 is transferred from the ink fill pump 1750 to the degassing element 1760 by a post pump ink conduit 1762. The degassing element 1760 removes gas from the ink composition 1711. Details of the degassing element 1760 will be described using an exemplary degassing filter element 2000 presented in FIG. 24. The ink composition 1711 is processed as ink composition 1711 passes through the degassing element 1760 and continues to the ink dispensing station 1720 by way of a processed ink to fill station conduit 1768. A vacuum is applied to the degassing element 1760, wherein the vacuum is generated by a degassing filter vacuum pump 1770 and transferred to the degassing element 1760 by fluid communication through a degassing filter vacuum draw line 1772. The processed ink composition 1711 is dispensed through the ink dispensing station 1720. The ink dispensing station 1720 is representative of any dispensing system, including a dispensing method for filling a standard ink cartridge, a wide format ink cartridge, an ink distribution reservoir, and the like. The exemplary ink dispensing station 1720 comprises the same elements as the first individual refill station 1220 illustrated in FIG. 13, wherein like elements of the ink dispensing station 1720 and the first individual refill station 1220 are numbered the same except preceded by the numeral '17', with the exclusion of the ink fill needle 1300, which is identified as an ink fill needle 1799. It is understood that the ink dispensing station 1720 is only exemplary and the ink cartridge pre-fill processing 1700 can utilize any ink delivery system, wherein the implemented ink delivery system would be respective to the selected ink receiving device. It is also understood that the ink cartridge pre-fill processing 1700 can be adapted to any printer, wherein the particle filter element 1740 and/or the degassing element 1760 can be integrated into the print system between an integrated source ink reservoir 1710 and a print head not shown, but represented by the ink dispensing station 1720. Although the exemplary ink cartridge pre-fill processing 1700 employs both the particle filter element 1740 and the degassing element 1760, it is understood that the ink cartridge pre-fill processing 1700 can include the particle filter element 1740 and/or the degassing element 1760. It is also understood that, although the exemplary embodiment is understood to be optimal, the particle filter element 1740 can be integrated into the ink cartridge pre-fill processing 1700 at a location after the ink fill pump 1750. In yet another alternative embodiment, the degassing element 1760 can be integrated into the ink cartridge pre-fill processing 1700 at a location prior to the ink fill pump 1750. For terminology, a volume of ink composition 1711 processed through the particle filter element 1740 can be referred to as particle reduced ink; a volume of ink composition 1711 processed through the degassing element 1760 can be referred to as gas reduced ink; and a volume of ink composition 1711 processed through both the particle filter element 1740 and the degassing element 1760 can be referred to as particle and gas reduced ink.

Figure 22:
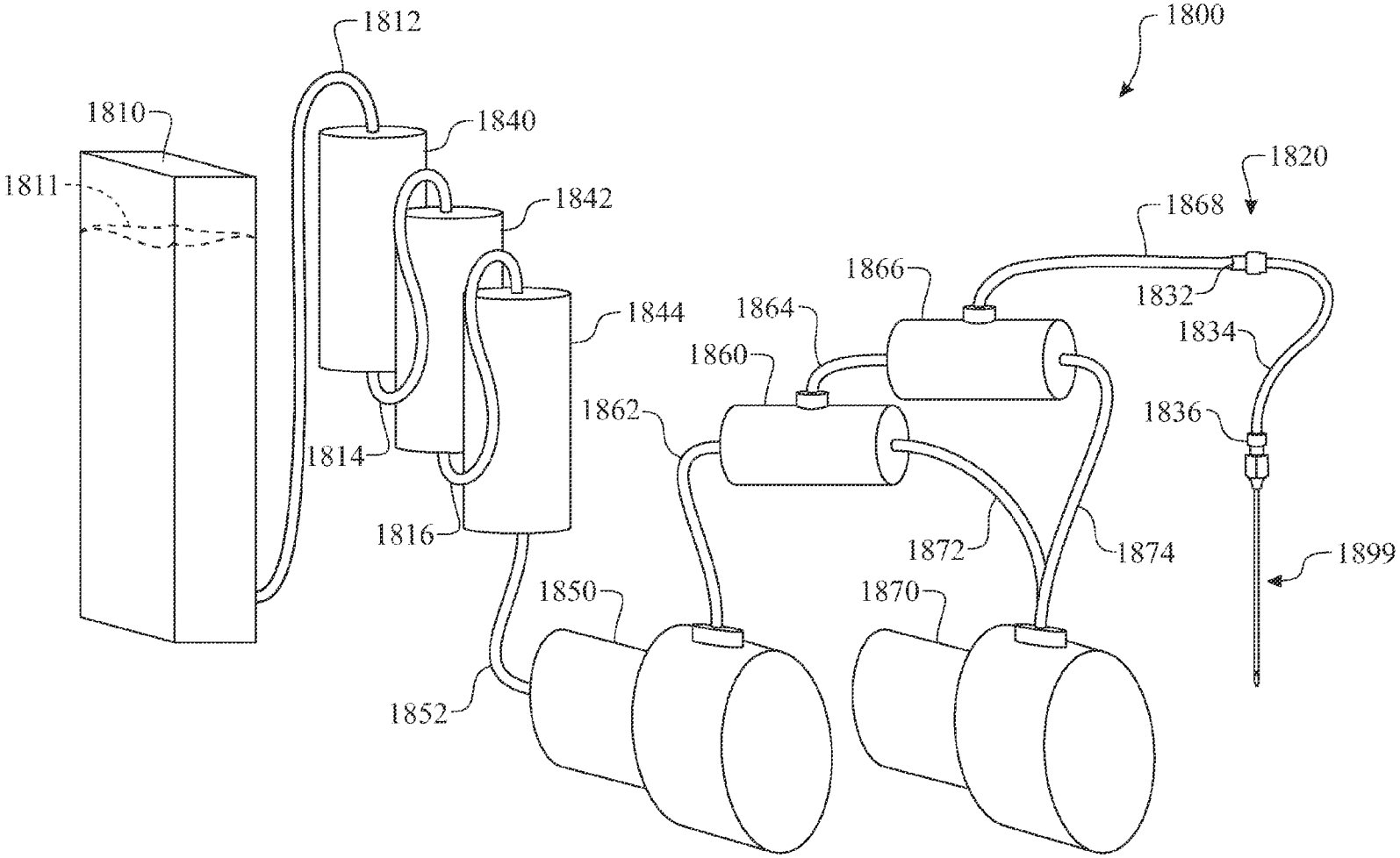
FIG. 22 presents a schematic diagram of an exemplary multi-stage particle filtration and multi-stage degassing ink preparation process.

An exemplary ink cartridge pre-fill processing 1800, as illustrated in FIG. 22, is an enhanced version of the ink cartridge pre-fill processing 1700. The exemplary ink cartridge pre-fill processing 1800 comprises the same elements as the ink cartridge pre-fill processing 1700 illustrated in FIG. 21, wherein like elements of the ink cartridge pre-fill processing 1800 and the ink cartridge pre-fill processing 1700 are numbered the same except preceded by the numeral '18'. In the ink cartridge pre-fill processing 1800, the particle filter is replicated, introducing a second particle filter element 1842 and an third particle filter 1844, wherein the second particle filter element 1842 and third particle filter 1844 are integrated into the ink cartridge pre-fill processing 1800 in a serial arrangement. In the exemplary serial arrangement, the ink composition 1811 is transferred from the source ink reservoir 1810 to the first particle filter element 1840 through a pre filter ink source conduit 1812. The ink composition 1811 continues along a predetermined path through a first filtered ink source conduit 1814 into the second particle filter element 1842 for a secondary particle filtration. The ink composition 1811 continues along a predetermined path through a second filtered ink source conduit 1816 into the third particle filter 1844 for a third particle filtration. In the exemplary embodiment, the first particle filter element 1840 would remove particles greater than a first diameter, the second particle filter element 1842 would remove particles greater than a second diameter, wherein the second diameter is smaller than the first diameter, and the third particle filter 1844 would remove particles greater than a third diameter, wherein the third diameter is smaller than the second diameter. In an exemplary embodiment, the first particle filter element 1840 would remove 5.0 micron or 5.0 micrometer sized particles, the second particle filter element 1842 would remove 1.0 micron or 1.0 micrometer sized particles, and the third particle filter 1844 would remove 0.05 micron or 0.05 micrometer sized particles. This tiered filtration configuration extends the life of each of the particle filters 1840, 1842, 1844, as each filter 1840, 1842, 1844 removes a portion of the particulate matter compared to a single particle filter configuration of ink cartridge pre-fill processing 1700, wherein all of the particulate matter is collected in the single particle filter element 1740.

Similarly, gas can be removed from an ink composition 1811 using a plurality of degassing elements 1860, 1866. The first degassing element 1860 would remove a first Parts Per Million (PPM) level (such as 4.0 PPM) of gas from the ink composition 1811 and the second degassing element 1866 would remove a second and finer PPM level of gas (such as 2.0 PPM) from the ink composition 1811. The ink composition 1811 would be supplied to the first degassing element 1860 from an ink fill pump 1850 through a post pump ink conduit 1862. The degassed ink composition 1811 is transferred to a subsequent, second degassing element 1866 through a first post degassing ink conduit 1864. One processed through the series of degassing elements 1860, 1866, the post processed ink composition 1811 is forwarded to the individual ink dispensing station 1820 through a processed ink to fill station conduit 1868. Each of the first degassing element 1860 and second degassing element 1866 would be subjected to a vacuum provided by a degassing filter vacuum pump 1870 via a first degassing filter vacuum draw line 1872 and second degassing filter vacuum draw line 1874, respectively.

It is understood that a tiered filtration configuration provides one means for improving longevity of the system. Alternatively, the filtration system can be arranged in a parallel configuration. More specifically, the particle filters 1840, 1842, 1846 can be arranged in a parallel configuration. Similarly, the degassing elements 1860, 1866 can be arranged in a parallel configuration. This configuration could be used to increase volumetric flow of the ink composition 1811.

For terminology, a volume of ink composition 1811 processed through the particle filter element 1840 can be referred to as particle reduced ink; a volume of ink composition 1811 processed through the degassing element 1860 can be referred to as gas reduced ink; and a volume of ink composition 1811 processed through both the particle filter element 1840 and the degassing element 1860 can be referred to as particle and gas reduced ink. Additionally, ink processed through the second particle filter element 1842 or any subsequent particle filter element can be referred to as further refined particle reduced ink. Additionally, ink processed through the second degassing element 1866 or any other subsequent degassing element can be referred to as further refined gas reduced ink.

Figure 23:
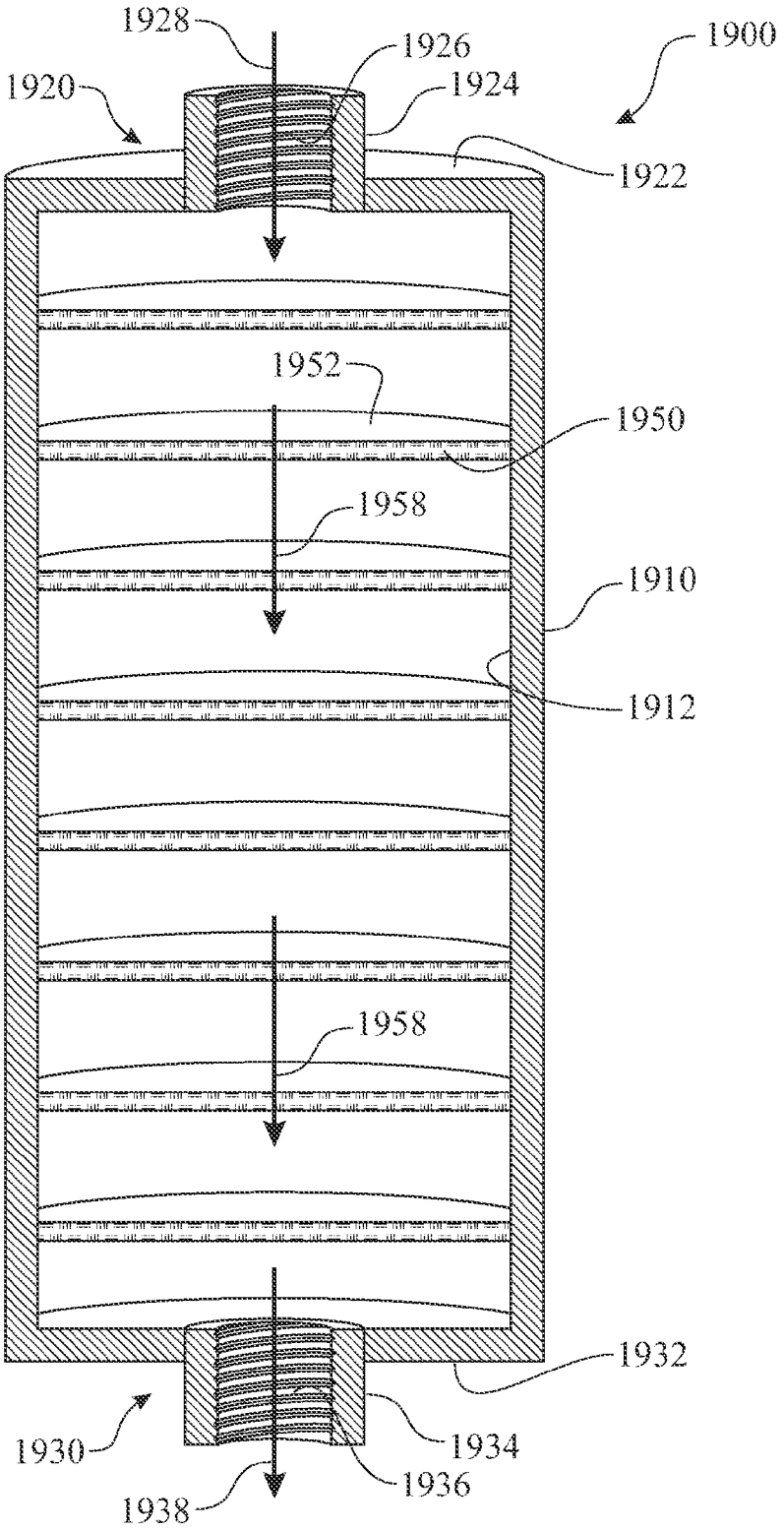
FIG. 23 presents a cross sectional drawing an exemplary particle filtration element, the section being taken along a longitudinal axis of the particle filtration element.

A particle filter element 1900 is presented in FIG. 23 as an exemplary embodiment of the particle filter element 1740, 1840, 1842, 1844. The particle filter element 1900 includes a fluid impervious casing comprising an elongated tubular casing segment 1910 having a particle filtration inlet 1920 assembled to an inlet end of the elongated tubular casing segment 1910 and a particle filtration discharge end 1930 assembled to a discharge end of the elongated tubular casing segment 1910. The elongated tubular casing segment 1910 comprises a hollow interior defined by an elongated tubular casing interior 1912. The particle filtration inlet 1920 includes a particle filtration inlet end cap 1922, wherein the particle filtration inlet end cap 1922 can be a separate element assembled to the elongated tubular casing segment 1910 or integrated into a unitary assembly comprising the elongated tubular casing segment 1910 and the particle filtration inlet end cap 1922 (as illustrated). The particle filtration discharge end 1930 includes a particle filtration discharge end cap 1932, wherein the particle filtration discharge end cap 1932 can be a separate element assembled to the elongated tubular casing segment 1910 or integrated into a unitary assembly comprising the elongated tubular casing segment 1910 and the particle filtration discharge end cap 1932 (as illustrated).

A particle filtration system is assembled within the elongated tubular casing interior 1912 of the elongated tubular casing segment 1910, between the particle filtration inlet 1920 and the particle filtration discharge end 1930. The particle filtration system can be any suitable filtration system known by those skilled in the art. In the exemplary embodiment, a series of particle filter 1950 are spatially arranged within the elongated tubular casing interior 1912, each particle filter 1950 being oriented with a particle filter source surface 1952 exposed to a particle filtration fluid flow 1958.

At least one particle filter element 1900 is integrated into the ink cartridge pre-fill processing 1700, 1800, being referenced as a particle filter element 1740, 1840, 1842, 1844. The particle filtration inlet 1920 includes a particle filtration inlet coupler 1924, wherein the particle filtration inlet coupler 1924 provides connectivity for fluid communication between the source ink reservoir 1710, 1810 and the particle filter element 1900. The particle filtration inlet coupler 1924 can incorporate any piping connection form factor, such as particle filtration inlet coupler threading 1926, a smooth wall for an adhesive or chemical welding assembly, and the like. The ink composition 1711, 1811 would enter the particle filter element 1900 in accordance with the particle filtration inlet fluid flow 1928. The particle filtration discharge end 1930 includes a particle filtration discharge coupler 1934, wherein the particle filtration discharge coupler 1934 provides connectivity for fluid communication between the particle filter element 1900 and any downstream element, such as a 1750, 1850, a subsequent particle filter element 1900, an first degassing element 1860, and the like. The particle filtration discharge coupler 1934 can incorporate any piping connection form factor, such as particle filtration discharge coupler threading 1936, a smooth wall for an adhesive or chemical welding assembly, and the like. The ink composition 1711, 1811, in a post-processed or filtered state, would be discharged from the particle filter element 1900 in accordance with the particle filtration discharge fluid flow 1938. The particle filter element 1900 would be serviceable, replaceable, or both.

Figure 24:
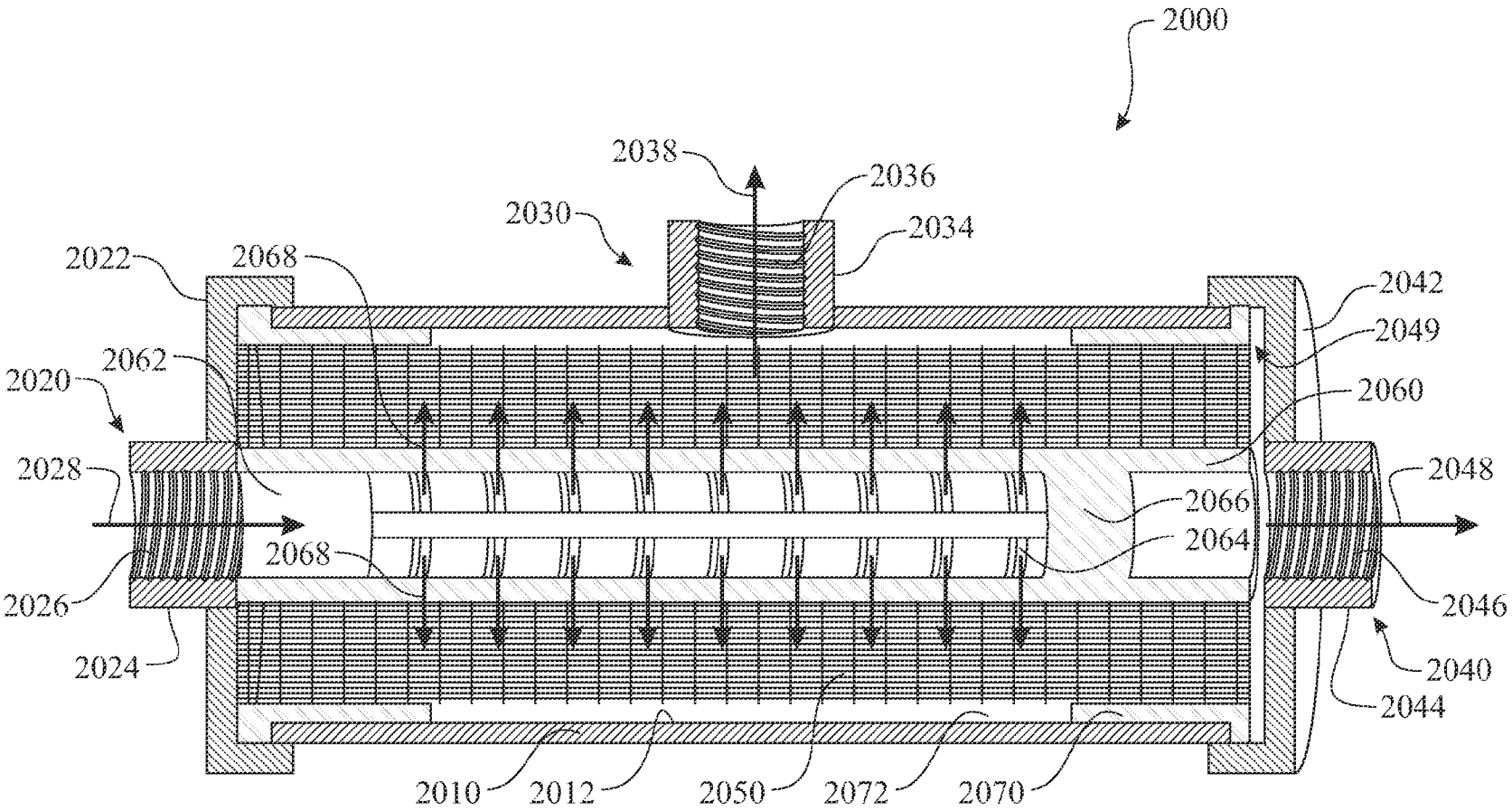
FIG. 24 presents a cross sectional drawing an exemplary degassing filter element, the section being taken along a longitudinal axis of the degassing filter element.

A degassing filter element 2000 is presented in FIG. 24 as an exemplary embodiment of the degassing filter element 1760, 1860, 1866. The degassing filter element 2000 includes a fluid impervious casing comprising a tubular filter section 2010 having a degassing filter inlet 2020 assembled to an inlet end of the tubular filter section 2010 and a degassing filter vacuum 2040 assembled to a vacuum drawing end of the tubular filter section 2010. A degassing filter discharge 2030 is integral to the degassing filter element 2000 at a central location of the tubular filter section 2010. The tubular filter section 2010 comprises a hollow interior defined by a tubular filter section interior 2012. The degassing filter inlet 2020 includes a degassing filter inlet end cap 2022, wherein the degassing filter inlet end cap 2022 can be a separate element assembled to the tubular filter section 2010 (as illustrated) or integrated into a unitary assembly comprising the tubular filter section 2010 and the degassing filter inlet end cap 2022. The degassing filter discharge 2030 includes a degassing filter discharge coupler 2034 preferably extending radially from a central location of the tubular filter section 2010. The degassing filter discharge end cap 2032 can be a separate element assembled to the tubular filter section 2010 (as illustrated) or integrated into a unitary assembly comprising the tubular filter section 2010 and the degassing filter discharge end cap 2032. The degassing filter vacuum 2040 includes a degassing filter vacuum end cap 2042, wherein the degassing filter vacuum end cap 2042 can be a separate element assembled to the tubular filter section 2010 (as illustrated) or integrated into a unitary assembly comprising the tubular filter section 2010 and the degassing filter vacuum end cap 2042. The degassing filter vacuum end 2040 includes a degassing filter vacuum coupler 2044, wherein the degassing filter vacuum coupler 2044 provides connectivity for vacuum communication between the degassing filter vacuum pump 1770, 1870 and the degassing filter element 2000. The degassing filter vacuum coupler 2044 can incorporate any piping connection form factor, such as degassing filter vacuum coupler threading 2046, a smooth wall for an adhesive or chemical welding assembly, and the like.

A degassing filtration system is assembled within the tubular filter section interior 2012 of the tubular filter section 2010. The degassing filtration system can be any suitable filtration system known by those skilled in the art. The exemplary degassing filtration system includes an ink dispersion element 2060 extending axially between the degassing filter inlet 2020 and the degassing filter vacuum 2040 and a degassing filter medium 2050 extending radially between an exterior surface of the ink dispersion element 2060 and the tubular filter section interior 2012. A plurality of spatially arranged ink discharge passageways 2064 are formed through a sidewall section of the ink dispersion element 2060. The exemplary ink discharge passageways 2064 are formed about just under a quarter of the circumference, forming four (4) equally spaced longitudinal support beams. It is understood that the formation of the ink discharge passageways 2064 and respective resulting number of longitudinal support beams can vary based upon the designer's choice. A degassing dispersion vacuum seal 2066 is integrated into a vacuum end of the ink dispersion element 2060, prior to the first adjacent ink discharge passageway 2064, as illustrated herein. The degassing dispersion vacuum seal 2066 provides a seal between an interior of the ink dispersion element 2060 forming an ink passageway and a vacuum provided through the degassing filter vacuum 2040. Filter seals 2070 are provided as an annular seal between the degassing filter medium 2050 and the tubular filter section interior 2012. One filter seal 2070 is integrated into the degassing filter element 2000 proximate the degassing filter inlet 2020 and a second filter seal 2070 is integrated into the degassing filter element 2000 proximate the degassing filter vacuum 2040. A gap between each of the filter seals defines a discharge ink collection clearance 2072 extending circumferentially between an exterior surface of the degassing filter medium 2050 and the tubular filter section interior 2012 of the tubular filter section 2010. The ink dispersion element 2060 abuts the degassing filter inlet 2020 forming a fluid impervious seal. The degassing filter vacuum 2040 is assembled to the tubular filter section 2010 forming a gap between an adjacent end of the ink dispersion element 2060 and an interior surface of the degassing filter vacuum 2040. Similarly, a gap, forming a degassing filter vacuum passageway 2049, is formed between an adjacent end of the degassing filter medium 2050 and an interior surface of the degassing filter vacuum 2040. The degassing filter vacuum passageway 2049 provides fluid communication for a degassing filter vacuum fluid flow 2048, enabling the degassing filter vacuum fluid flow 2048 to draw a vacuum on the degassing filter medium 2050.

In use, a volume of ink composition 1711, 1811 enters the degassing filter element 2000 through the degassing filter inlet coupler 2024 in accordance with the degassing filter inlet fluid flow 2028. The volume of ink composition 1711, 1811 passes through the ink dispersion element 2060 and is distributed across an interior section of the degassing filter medium 2050 through the series of ink discharge passageways 2064. The distributed volume of ink composition 1711, 1811 is degassed passing through the degassing filter medium 2050. A vacuum is drawn through the degassing filter vacuum end 2040 in accordance with the degassing filter vacuum fluid flow 2048. The degassing filter vacuum fluid flow 2048 is directed to drawing a vacuum along the vacuum end of the degassing filter medium 2050 by way of the degassing filter vacuum passageway 2049. The processed volume of ink composition 1711, 1811 is collected through the discharge ink collection clearance 2072 and dispensed or returned to the system through the degassing filter discharge coupler 2034.

At least one degassing filter element 2000 is integrated into the ink cartridge pre-fill processing 1700, 1800, being referenced as a degassing filter element 1760, 1860, 1866. The degassing filter inlet 2020 includes a degassing filter inlet coupler 2024, wherein the degassing filter inlet coupler 2024 provides connectivity for fluid communication between the source ink reservoir 1710, 1810 (more specifically the ink fill pump 1750, 1850) and the degassing filter element 2000. The degassing filter inlet coupler 2024 can incorporate any piping connection form factor, such as degassing filter inlet coupler threading 2026, a smooth wall for an adhesive or chemical welding assembly, and the like. The ink composition 1711, 1811 would enter the degassing filter element 2000 in accordance with the degassing filter inlet fluid flow 2028. The degassing filter discharge 2030 includes a degassing filter discharge coupler 2034, wherein the degassing filter discharge coupler 2034 provides connectivity for fluid communication between the degassing filter element 2000 and any ink dispensing system such as the exemplary individual ink dispensing station 1720, 1820. The degassing filter discharge coupler 2034 can incorporate any piping connection form factor, such as degassing filter discharge coupler threading 2036, a smooth wall for an adhesive or chemical welding assembly, and the like. The ink composition 1711, 1811, in a post-processed or degassed state, would be discharged from the degassing filter element 2000 in accordance with the degassing filter discharge fluid flow 2038. The degassing filter element 2000 would be serviceable, replaceable, or both.

In use, volume of ink composition 1711 1811 enters the degassing filter element 2000 through the degassing filter inlet coupler 2024 in accordance with the degassing filter inlet fluid flow 2028. The volume of ink composition 1711 1811 continues through the ink dispersion inlet 2062, being disbursed onto the degassing filter medium 2050 through the series of spatially arranged ink discharge passageways 2064 in accordance with an ink dispersion flow 2068. The volume of ink composition 1711 1811 passes through the degassing filter medium 2050. The degassing filter medium 2050, in combination with the degassing filter vacuum fluid flow 2048, draws gas from the volume of ink composition 1711, 1811. The degassing filter vacuum fluid flow 2048 is drawn through the degassing filter vacuum coupler 2044. Vacuum is subjected to the degassing filter medium 2050 by way of the degassing filter vacuum passageway 2049. The degassing filter vacuum passageway 2049 provides a fluid conduit between a vacuum end of the degassing filter medium 2050 and the degassing filter vacuum coupler 2044. The processed ink composition 1711, 1811 exits the degassing filter element 2000 through the degassing filter discharge coupler 2034 in accordance with the degassing filter discharge fluid flow 2038. Since any processing of the ink composition 1711, 1811, such as the ink fill pump 1750, 1850, can introduce gas therein, it is preferred to integrate the degassing filter element 2000 into the ink cartridge pre-fill processing 1700, 1800 at a location proximate the final dispensing elements. As previously described the degassing filter element 2000 can be integrated as a single unit or as multiple units in either a parallel or a serial arrangement.

Figure 25:
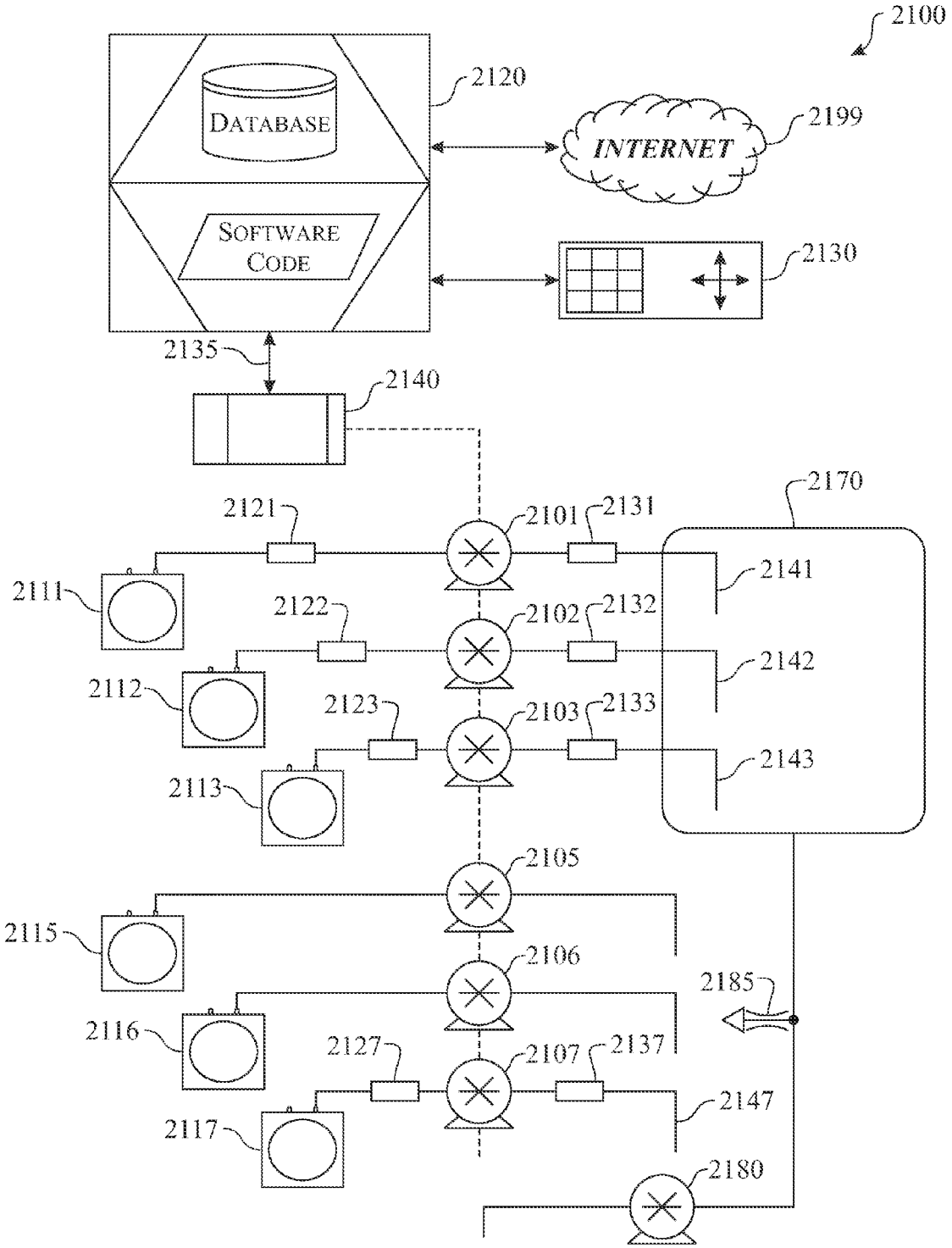
FIG. 25 presents an exemplary block diagram illustrating a system for refilling a printer cartridge incorporating a particle filter and a degassing filter for each ink color dispensing subsystem.

A first example implementing the particle filter element 1900 and degassing filter element 2000 is presented as a computer ink cartridge refilling system 2100 illustrated in FIG. 25. The computer ink cartridge refilling system 2100 is an enhanced version of the computer ink cartridge refilling system 100 illustrated in FIG. 1, wherein like elements of the computer ink cartridge refilling system 2100 and the computer ink cartridge refilling system 100 are numbered the same except preceded by the numeral '21'. The enhancements integrate a particle filter element 1900 between each ink reservoir and a respective ink fill pump and a degassing filter element 2000 between each ink fill pump and respective ink dispensing element. The integrated particle filter elements 1900 are designated as a yellow ink particle filtration element 2121, a cyan ink particle filtration element 2122, a magenta ink particle filtration element 2123, and a black ink particle filtration element 2127. The yellow ink particle filtration element 2121 is integrated between a yellow reservoir 2111 and a yellow ink pump 2101. The cyan ink particle filtration element 2122 is integrated between a cyan reservoir 2112 and a cyan ink pump 2102. The magenta ink particle filtration element 2123 is integrated between a magenta reservoir 2113 and a magenta ink pump 2103. The black ink particle filtration element 2127 is integrated between a black reservoir 2117 and a black ink pump 2107. Although each particle filter element 1900 is illustrated as being located between the respective reservoir 2111, 2112, 2113, 2117 and the respective ink pump 2101, 2102, 2103, 2107, it is understood that the particle filter element 1900 can be integrated into the computer ink cartridge refilling system 2100 at a location down flow from the respective ink pump 2101, 2102, 2103, 2107.

The integrated degassing filter elements 2000 are designated as a yellow ink degassing filter element 2131, a cyan ink degassing filter element 2132, a magenta ink degassing filter element 2133, and a black ink degassing filter element 2137. The yellow ink degassing filter element 2131 is integrated between a yellow ink pump 2101 and a respective discharge element, yellow ink discharge element 2141. The cyan ink degassing filter element 2132 is integrated between a cyan ink pump 2102 and a respective discharge element, cyan ink discharge element 2142. The magenta ink degassing filter element 2133 is integrated between a magenta ink pump 2103 and a respective discharge element, magenta ink discharge element 2143. The black ink degassing filter element 2137 is integrated between a black ink pump 2107 and a respective discharge element, black ink discharge element 2147. Although each degassing filter element 2000 is illustrated as being located between the respective ink pump 2101, 2102, 2103, 2107 and the respective dispensing element 2141, 2142, 2143, 2147, it is understood that the degassing filter element 2000 can be integrated into the computer ink cartridge refilling system 2100 at a location up flow from the respective ink pump 2101, 2102, 2103, 2107.

The exemplary computer ink cartridge refilling system 2100 includes a particle filter element 1900 and a degassing filter element 2000, it is understood that the computer ink cartridge refilling system 2100 can be modified in a variety of configurations while maintaining the spirit and intent of the present invention. As presented in the ink cartridge pre-fill processing 1800, the computer ink cartridge refilling system 2100 can include a plurality of the particle filter elements 1900 and/or a plurality of the degassing filter elements 2000. It is also understood the designer can implement one of at least one particle filter element 1900 or at least one degassing filter element 2000.

Figure 26:
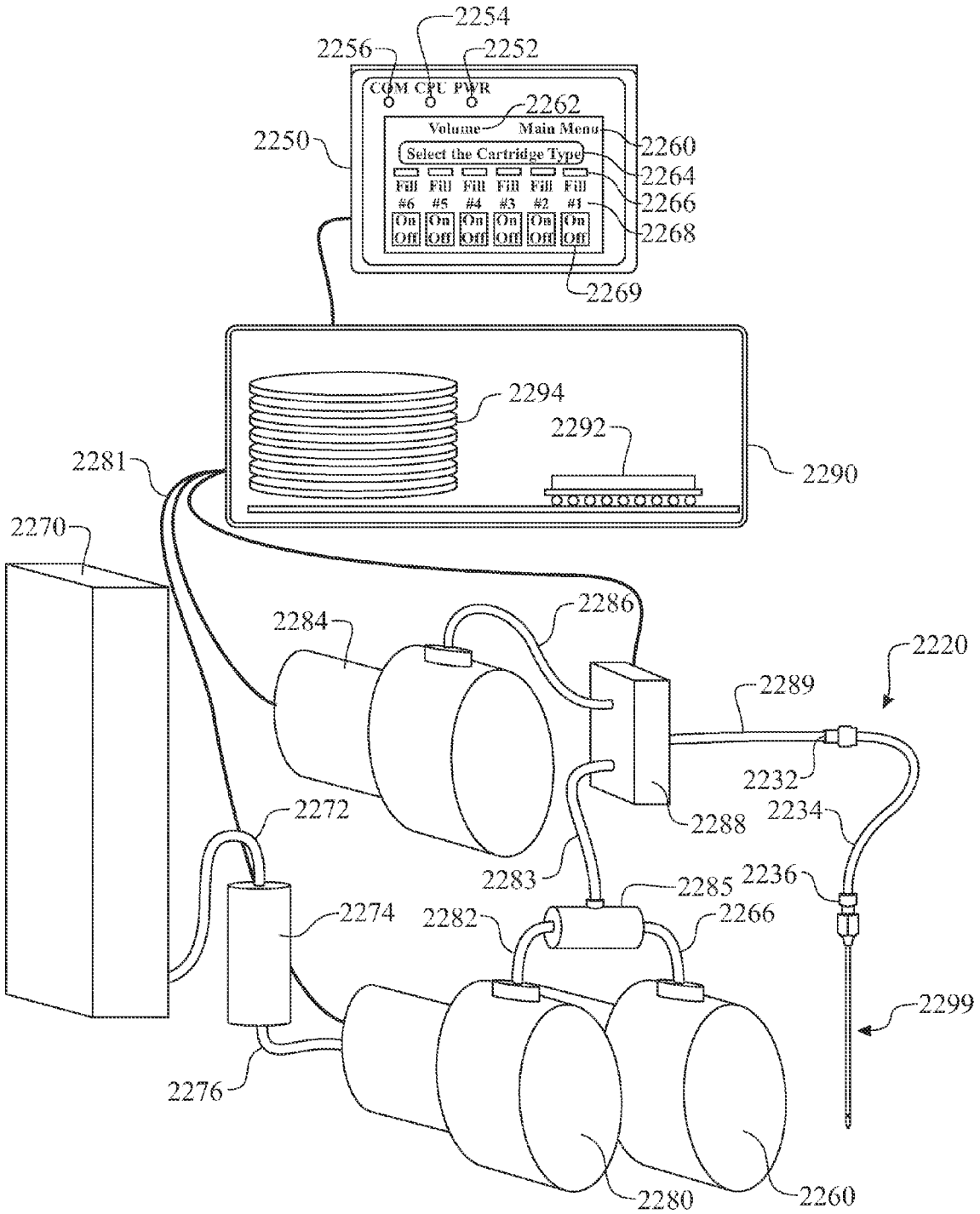
FIG. 26 presents an exemplary block diagram illustrating a system for refilling a wide format ink cartridge incorporating a particle filter and a degassing filter for one exemplary ink color dispensing subsystem.

A second example implementing the particle filter element 1900 and degassing filter element 2000 is presented as a wide format cartridge refill station 2200 illustrated in FIG. 26. The wide format cartridge refill station 2200 is an enhanced version of the wide format cartridge refill station 1200 illustrated in FIG. 13, wherein like elements of the wide format cartridge refill station 2200 and the wide format cartridge refill station 1200 are numbered the same except preceded by the numeral '22'. The enhancements integrate a particle filter element 1900 between each ink reservoir and a respective ink fill pump and a degassing filter element 2000 between the respective ink fill pump and respective ink dispensing element. The integrated particle filter element 1900 is designated as a particle filtration element 2274. The particle filtration element 2274 is integrated between a source ink reservoir 2270 and an ink fill pump 2280. Although the particle filtration element 2274 is illustrated as being located between the source ink reservoir 2270 and the ink fill pump 2280, it is understood that the particle filtration element 2274 can be integrated into the wide format cartridge refill station 2200 at a location down flow from the ink fill pump 2280.

The integrated degassing filter element 2000 is designated as a degassing filter element 2285. The degassing filter element 2285 is integrated between the ink fill pump 2280 and an ink refill station 2220. Although the degassing filter element 2285 is illustrated as being located between the ink fill pump 2280 and the ink refill station 2220, it is understood that the degassing filter element 2285 can be integrated into the computer ink cartridge refilling system 2100 at a location up flow from the ink fill pump 2280.

The exemplary wide format cartridge refill station 2200 includes a particle filter element 1900 and a degassing filter element 2000, it is understood that the wide format cartridge refill station 2200 can be modified in a variety of configurations while maintaining the spirit and intent of the present invention. It is also understood the designer can implement one of at least one particle filter element 1900 or at least one degassing filter element 2000. As presented in the ink cartridge pre-fill processing 1800, the wide format cartridge refill station 2200 can include a plurality of the particle filter elements 1900 and/or a plurality of the degassing filter elements 2000. The plurality of the particle filter elements 1900 can be integrated in parallel arrangement, a serial arrangement, or both. Similarly, the plurality of the degassing filter elements 2000 can be integrated in parallel arrangement, a serial arrangement, or both.

Figure 27:
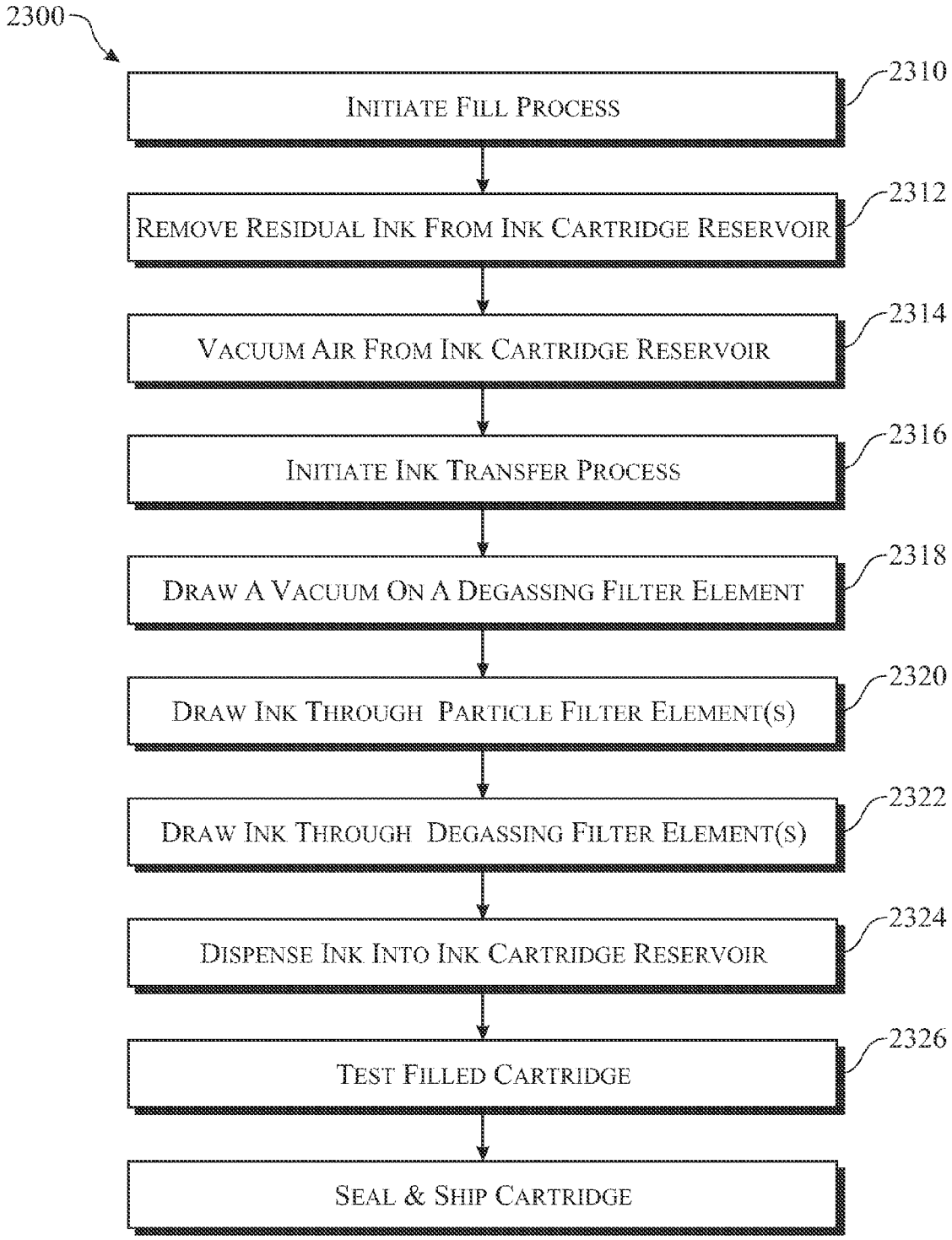
FIG. 27 presents an exemplary predispense ink processing flow diagram.

An exemplary pre-dispensing ink process flow diagram 2300 is presented in FIG. 27. The pre-dispensing ink process flow diagram 2300 describes, in linear form, the method associated with the various configurations of apparatuses previous described herein. The pre-dispensing ink process flow diagram 2300 commences with an initiation step 2310. If refilling a dispensed ink cartridge, any residual ink is removed from the ink cartridge reservoir in accordance with an ink removal step 2312. The ink cartridge continues to be prepared for receipt of fresh ink by applying a vacuum to the reservoir within the ink cartridge in accordance with an air removal step 2314. Once the ink cartridge is prepared to receive fresh ink, the process initiates transferring ink from a reservoir to the ink cartridge in accordance with an ink transfer initiation step 2316. In parallel, the ink cartridge reservoir can be subjected to a negative pressure or vacuum and a vacuum is drawn upon the degassing filter element as directed by step 2318. Ink composition is drawn from a reservoir and through an at least one particle filter element as directed in a particle filtration step 2320.

The ink can pass through one particle filter element, a plurality of particle filter elements provided in a serial arrangement, a plurality of particle filter elements provided in a parallel arrangement, or a plurality of particle filter elements having a portion of the particle filter elements provided in a serial arrangement and a portion of the particle filter elements provided in a parallel arrangement. In a serial arrangement, the particle filter elements would be arranged to remove the largest particles in the first particle filter element and the smallest or finest particles in the last particle filter element. In a parallel arrangement, each of the particle filter elements would remove the same particle size. The partially processed ink continues to be purified, wherein the ink is subjected to a degassing process in accordance with a degassing step 2322. The degassing step utilizes a mechanical filtration that is additionally subjected to a vacuum to remove air from the fluid. The The ink can pass through one degassing filter element, a plurality of degassing filter elements provided in a serial arrangement, a plurality of degassing filter elements provided in a parallel arrangement, or a plurality of degassing filter elements having a portion of the degassing filter elements provided in a serial arrangement and a portion of the degassing filter elements provided in a parallel arrangement. In a serial arrangement, the degassing filter elements would be arranged to remove the largest gas bubbles in the first degassing filter element and the smallest or finest gas bubbles in the last degassing filter element. In a parallel arrangement, each of the degassing filter elements would remove the same bubble size.

Once the ink completes both the particle filtration process and the degassing process, the ink is dispensed into the target container. In the exemplary embodiment, the ink is dispensed into the prepared ink cartridge reservoir as directed in an ink dispensing step 2324. Once the ink cartridge is determined to be filled, the ink cartridge is subjected to a predefined quality test program as directed in an ink cartridge testing step 2326. Upon successful testing, the filled ink cartridge is sealed, packaged and prepared for shipment to the customer, as noted in step 2328.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. A method of refilling a printer ink cartridge, the method comprising steps of:
- obtaining an ink dispensing system for transferring ink from an ink reservoir to a said printer ink cartridge, said ink dispensing system comprising:
  - an ink dispensing element,
  - an ink pump placed in fluid communication between said ink reservoir and said ink dispensing element,
  - a first degassing filter element integrated in fluid communication between said ink reservoir and said ink dispensing element,
  - a second degassing filter element integrated in fluid communication between said first degassing filter element and said ink dispensing element, and
  - a series of ink supply conduits providing fluid communication between said ink reservoir, said ink pump, said first degassing filter element, said second degassing filter element, and said ink dispensing element;
- drawing ink from said ink reservoir, wherein said ink pump generates a flow of said ink through said series of ink supply conduits;
- passing said ink through said first degassing filter element, wherein said first degassing filter element removes gas from said ink, converting said ink to a gas reduced ink;
- passing said particle reduced ink through said second degassing filter element, wherein said second degassing filter element also removes residual gas from said particle reduced ink, converting said particle reduced ink to gas reduced ink;
- transferring said gas reduced ink to said ink dispensing element; and
- discharging said gas reduced ink from said ink dispensing element into said printer ink.

2. A method of refilling a printer ink cartridge as recited in claim 1, further comprising a step of drawing a vacuum upon an interior of at least one of said first degassing filter element and said second degassing filter element.

3. A method of refilling a printer ink cartridge as recited in claim 1, wherein said second degassing filter element is integrated in series with said first degassing filter element, wherein said second degassing filter element in fluid communication between said first degassing filter element and said ink dispensing element, further comprising a step of:
- passing said gas reduced ink through said second degassing filter element, wherein said second degassing filter element removes additional residual gas from said gas reduced ink, converting said gas reduced ink to a further refined gas reduced ink.

4. A method of refilling a printer ink cartridge as recited in claim 1, wherein said second degassing filter element is integrated in parallel with said first degassing filter element, wherein said first degassing filter element and said second degassing filter element are provided in fluid communication between said ink reservoir and said ink dispensing element, further comprising a step of:

passing said ink through said first degassing filter element and said second degassing filter element in parallel, wherein first degassing filter element and said second degassing filter element removes gas from said ink, converting said ink to said gas reduced ink.

5. A method of refilling a printer ink cartridge as recited in claim 1, said first degassing filter element is arranged between said ink pump and said ink dispensing element further comprising a step of:

passing said ink through said ink pump, then passing said ink through said first degassing filter element, wherein first degassing filter element removes gas included in said ink from said ink reservoir and additional gas introduced into said ink when said ink passed through said ink pump, converting said ink to said gas reduced ink.

6. A method of refilling a printer ink cartridge as recited in claim 5, wherein said second degassing filter element is in series with said first degassing filter element, said second filter element being integrated in fluid communication between said first degassing filter element and said ink dispensing element, further comprising a step of:

passing said gas reduced ink through said second degassing filter element, wherein said second degassing filter element removes additional residual gas from said gas reduced ink, converting said gas reduced ink to a further refined gas reduced ink.

7. A method of refilling a printer ink cartridge as recited in claim 1, wherein said second degassing filter element is integrated in parallel with said first degassing filter element, wherein said first degassing filter element and said second degassing filter element are provided in fluid communication between said ink pump and said ink dispensing element, further comprising a step of:

passing said ink through said first degassing filter element and said second degassing filter element in parallel and subsequent to said ink pump, wherein first degassing filter element and said second degassing filter element removes gas from said ink, converting said ink to said gas reduced ink.

8. A method of refilling a printer ink cartridge, the method comprising steps of:

obtaining an ink dispensing system for transferring ink from an ink reservoir to a said printer ink cartridge, said ink dispensing system comprising:

an ink dispensing element, an ink pump placed in fluid communication between said ink reservoir and said ink dispensing element, a particle filtration element integrated in fluid communication between said ink reservoir and said ink dispensing element, a first degassing filter element integrated in fluid communication between said particle filtration element and said ink dispensing element, a second degassing filter element integrated in fluid communication between said first degassing filter element and said ink dispensing element, and a series of ink supply conduits providing fluid communication between said ink reservoir, said ink pump, said first degassing filter element, said second degassing filter element, and said ink dispensing element;

drawing ink from said ink reservoir, wherein said ink pump generates a flow of said ink through said series of ink supply conduits;

passing said ink through said particle filtration element, wherein said particle filtration element removes suspended particles from said ink, converting said ink to a particle reduced ink;

passing said particle reduced ink through said first degassing filter element, wherein said first degassing filter element removes gas from said particle reduced ink, converting said particle reduced ink to a particle and gas reduced ink;

passing said particle reduced ink through said second degassing filter element, wherein said second degassing filter element also removes residual gas from said particle reduced ink, converting said particle reduced ink to gas reduced ink;

transferring said particle and gas reduced ink to said ink dispensing element;

discharging said particle and gas reduced ink from said ink dispensing element into said printer ink cartridge.

9. A method of refilling a printer ink cartridge as recited in claim 8, further comprising a step of drawing a vacuum upon an interior of said first degassing filter element.

10. A method of refilling a printer ink cartridge as recited in claim 8, wherein said second degassing filter element is integrated in series with said first degassing filter element, wherein said second degassing filter element in fluid communication between said first degassing filter element and said ink dispensing element, further comprising a step of:

passing said particle and particle and gas reduced ink through said second degassing filter element, wherein said second degassing filter element removes additional residual gas from said particle and gas reduced ink, converting said particle and gas reduced ink to a further refined particle and gas reduced ink.

11. A method of refilling a printer ink cartridge as recited in claim 8, wherein said second degassing filter element is integrated in parallel with said first degassing filter element in fluid communication between said ink reservoir and said ink dispensing element, further comprising a step of:

passing said particle reduced ink through said first degassing filter element and said second degassing filter element in parallel, wherein first degassing filter element and said second degassing filter element removes gas from said particle reduced ink, converting said particle reduced ink to said particle and gas reduced ink.

12. A method of refilling a printer ink cartridge as recited in claim 8, said first degassing filter element is arranged between said ink pump and said ink dispensing element further comprising a step of:

passing said particle reduced ink through said ink pump, then passing said particle reduced ink through said first degassing filter element, wherein said first degassing filter element removes gas included in said particle reduced ink from said particle filtration element and additional gas introduced into said particle reduced ink when said particle reduced ink passed through said ink pump, converting said particle reduced ink to said gas reduced ink.

13. A method of refilling a printer ink cartridge as recited in claim 12, said wherein said second degassing filter element is in series with said first degassing filter element, said second filter element being integrated in fluid communication between said first degassing filter element and said ink dispensing element, further comprising a step of:

passing said particle and gas reduced ink through said second degassing filter element, wherein said second degassing filter element removes additional residual gas from said particle and gas reduced ink, converting said particle and gas reduced ink to a further refined particle and gas reduced ink.

14. A method of refilling a printer ink cartridge as recited in claim 8, wherein said second degassing filter element is integrated in parallel with said first degassing filter element, wherein said first degassing filter element and said second degassing filter element are provided in fluid communication between said ink pump and said ink dispensing element, further comprising a step of:

passing said particle reduced ink through said first degassing filter element and said second degassing filter element in parallel and subsequent to said ink pump, wherein first degassing filter element and said second degassing filter element removes gas from said particle reduced ink, converting said particle reduced ink to a particle and gas reduced ink.

15. A method of refilling a printer ink cartridge, the method comprising steps of:

obtaining an ink dispensing system for transferring ink from an ink reservoir to a said printer ink cartridge, said ink dispensing system comprising:

an ink dispensing element, an ink pump placed in fluid communication between said ink reservoir and said ink dispensing element, a particle filtration element integrated in fluid communication between said ink reservoir and said ink dispensing element, a first degassing filter element integrated in fluid communication between said particle filtration element and said ink dispensing element, a second degassing filter element integrated in fluid communication between said first degassing filter element and said ink dispensing element, a series of ink supply conduits providing fluid communication between said ink reservoir, said ink pump, said first degassing filter element, said second degassing filter element, and said ink dispensing element, and a vacuum pump;

removing residual ink from and ink reservoir of said printer ink cartridge;

providing a vacuum pressure within said ink reservoir of said printer ink cartridge using said vacuum pump;

drawing ink from said ink reservoir, wherein said ink pump generates a flow of said ink through said series of ink supply conduits;

passing said ink through said particle filtration element, wherein said particle filtration element removes suspended particles from said ink, converting said ink to a particle reduced ink;

passing said particle reduced ink through said first degassing filter element, wherein said first degassing filter element removes gas from said particle reduced ink, converting said particle reduced ink to a particle and gas reduced ink;

passing said particle reduced ink through said second degassing filter element, wherein said second degassing filter element also removes residual gas from said particle reduced ink, converting said particle reduced ink to gas reduced ink;

transferring said particle and gas reduced ink to said ink dispensing element; and discharging said particle and gas reduced ink from said ink dispensing element into said printer ink cartridge.

16. A method of refilling a printer ink cartridge as recited in claim 15, further comprising a step of drawing a vacuum upon an interior of at least one of said first degassing filter element and said second degassing filter element.

17. A method of refilling a printer ink cartridge as recited in claim 15, said ink dispensing system further comprising a second degassing filter element integrated in fluid communication between said first degassing filter element and said ink dispensing element, further comprising a step of:

passing said particle and particle and gas reduced ink through said second degassing filter element, wherein said second degassing filter element removes additional residual gas from said particle and gas reduced ink, converting said particle and gas reduced ink to a further refined particle and gas reduced ink.

18. A method of refilling a printer ink cartridge as recited in claim 15, wherein said second degassing filter element is integrated in parallel with said first degassing filter element, wherein said first degassing filter element and said second degassing filter element are provided in fluid communication between said ink reservoir and said ink dispensing element, further comprising a step of:

passing said particle reduced ink through said first degassing filter element and said second degassing filter element in parallel, wherein first degassing filter element and said second degassing filter element removes gas from said particle reduced ink, converting said particle reduced ink to said particle and gas reduced ink.

19. A method of refilling a printer ink cartridge as recited in claim 15, wherein said particle filtration filter element is arranged between said ink reservoir and said ink pump, wherein said step of passing said ink through said particle filtration element, wherein said particle filtration element removes suspended particles from said ink, converting said ink to a particle reduced ink is accomplished prior to a further step of passing said particle reduced ink through said ink pump.

20. A method of refilling a printer ink cartridge as recited in claim 15, said first degassing filter element and said second degassing filter element are arranged between said ink pump and said ink dispensing element further comprising a step of:

one of:

passing said ink through said ink pump and passing said ink through said particle filtration element, wherein said particle filtration element removes suspended particles from said ink, converting said ink to a particle reduced ink, and passing said ink through said particle filtration element, wherein said particle filtration element removes suspended particles from said ink, converting said ink to a particle reduced ink and passing said particle reduced ink through said ink pump; followed by a step of:

passing said particle reduced ink through said first degassing filter element and said second degassing filter element, wherein said first degassing filter element and said second degassing filter element removes gas included in said particle reduced ink from said particle filtration element and additional gas introduced into said particle reduced ink when said particle reduced ink passed through said ink pump, converting said particle reduced ink to said particle and gas reduced ink.

* * * * *